US008635810B2

(12) United States Patent
DeBoer et al.

(10) Patent No.: US 8,635,810 B2
(45) Date of Patent: Jan. 28, 2014

(54) SASH RETAINER BAR ASSEMBLY

(75) Inventors: Nathan H. DeBoer, Salol, MN (US); Timothy R. Bentow, Warroad, MN (US)

(73) Assignee: Marvin Windows and Doors, Eagan, MN (US)

( * ) Notice: Subject to any disclaimer, the term of this patent is extended or adjusted under 35 U.S.C. 154(b) by 91 days.

(21) Appl. No.: 13/213,942

(22) Filed: Aug. 19, 2011

(65) Prior Publication Data

US 2012/0042574 A1 Feb. 23, 2012

Related U.S. Application Data

(60) Provisional application No. 61/375,731, filed on Aug. 20, 2010.

(51) Int. Cl.
*E06B 3/32* (2006.01)

(52) U.S. Cl.
USPC ..... 49/463; 49/465; 49/404

(58) Field of Classification Search
USPC ..... 49/404, 463, 465, 181, 185, 183, 184
See application file for complete search history.

(56) References Cited

U.S. PATENT DOCUMENTS

| | | | | | |
|---|---|---|---|---|---|
| 1,041,803 | A | * | 10/1912 | Kilburn | 292/36 |
| 1,421,547 | A | | 7/1922 | Parsons | |
| 2,375,546 | A | | 5/1945 | Gaines et al. | |
| 3,434,236 | A | | 3/1969 | Weidner et al. | |
| 3,464,160 | A | * | 9/1969 | Anderson | 49/181 |
| 4,144,674 | A | * | 3/1979 | Dovman | 49/417 |
| 4,167,835 | A | * | 9/1979 | Nobes et al. | 49/449 |
| 4,283,883 | A | | 8/1981 | Sterner, Jr. | |
| 4,290,231 | A | | 9/1981 | Blair | |
| 4,324,072 | A | * | 4/1982 | Sterner, Jr. | 49/129 |
| 4,578,903 | A | * | 4/1986 | Simpson | 49/175 |
| 4,763,445 | A | * | 8/1988 | Silverman | 49/176 |
| 5,199,219 | A | | 4/1993 | Martini et al. | |
| 5,301,989 | A | | 4/1994 | Dallmann et al. | |
| 5,371,971 | A | * | 12/1994 | Prete | 49/380 |

(Continued)

OTHER PUBLICATIONS

"U.S. Appl. No. 12/433,319, Non Final Office Action mailed Jan. 24, 2012", 9 pgs.

(Continued)

*Primary Examiner* — Katherine Mitchell
*Assistant Examiner* — Shiref Mekhaeil
(74) *Attorney, Agent, or Firm* — Schwegman, Lundberg & Woessner, P.A.

(57) ABSTRACT

A retainer bar assembly for use with a door or window includes a retainer bar configured for slidable coupling with a fenestration frame and slidable coupling with a sash. A retainer bar handle is coupled with the retainer bar. A retainer bar fastener assembly includes a movable bolt movably coupled with the sash. The movable bolt is movable between a fastening configuration where the bolt is coupled with at least one of the retainer bar and the retainer bar handle and the retainer bar is fixed in an installed orientation relative to the sash, and a releasing configuration where the bolt is decoupled from one or more of the retainer bar and the retainer bar handle and the retainer bar is slidable relative to the sash. The retainer bar includes a retainer bar length configured to continuously couple along a sash portion from near a first sash end to near a second sash end, and the retainer bar length is configured to correspondingly couple along a fenestration frame and provide a continuous interface between the sash and the fenestration frame.

23 Claims, 19 Drawing Sheets

(56) References Cited

U.S. PATENT DOCUMENTS

| | | | | |
|---|---|---|---|---|
| 5,618,067 | A | 4/1997 | Carlson et al. | |
| 5,669,639 | A * | 9/1997 | Lawrence | 292/175 |
| 5,671,566 | A | 9/1997 | Tix et al. | |
| 5,918,419 | A | 7/1999 | Cangialosi et al. | |
| 6,155,615 | A * | 12/2000 | Schultz | 292/163 |
| 6,216,392 | B1 * | 4/2001 | DiGinosa | 49/183 |
| 6,604,324 | B1 * | 8/2003 | Maier | 49/181 |
| 6,817,142 | B2 * | 11/2004 | Marshik | 49/449 |
| 6,877,784 | B2 | 4/2005 | Kelley et al. | |
| 6,883,272 | B2 * | 4/2005 | Maier | 49/181 |
| 7,070,215 | B2 * | 7/2006 | Kelley et al. | 292/241 |
| 7,520,541 | B1 | 4/2009 | Lawrence | |
| 7,591,103 | B2 | 9/2009 | Tremble et al. | |
| 8,272,164 | B2 * | 9/2012 | Albrecht | 49/185 |
| 2004/0074146 | A1 * | 4/2004 | Eenigenburg | 49/183 |
| 2004/0168370 | A1 * | 9/2004 | Pettit et al. | 49/185 |
| 2006/0192391 | A1 * | 8/2006 | Pettit et al. | 292/5 |
| 2007/0209281 | A1 * | 9/2007 | Flory et al. | 49/183 |
| 2010/0018123 | A1 * | 1/2010 | Hendrickson | 49/176 |
| 2010/0050528 | A1 * | 3/2010 | Pettit et al. | 49/185 |
| 2010/0218425 | A1 * | 9/2010 | Nolte et al. | 49/185 |

OTHER PUBLICATIONS

"U.S. Appl. No. 12/433,319, Examiner Interview Summary mailed Apr. 26, 2012", 3 pgs.

"U.S. Appl. No. 12/433,319, Restriction Requirement mailed Sep. 28, 2011", 6 pgs.

"Product Catalog: Tilt Latches", Truth Hardware, Owatonna, MN; https://www.truth.com/main/catalog/contents/SW16%20Tilt%20Latches.r8.pdf.pdf, (Dec. 7, 2011), 8 pgs.

"Tilt Latches", Great Lakes Window Parts, http://greatlakeswindowparts.com/TILT-LATCHES.html, (Dec. 7, 2011), 8 pgs.

* cited by examiner

SASH RETAINER BAR ASSEMBLY

CROSS-REFERENCE TO RELATED APPLICATION

This application is a continuation-in-part application of U.S. Provisional Application Ser. No. 61/375,731 filed Aug. 20, 2010. The entire disclosure of U.S. Provisional Application Ser. No. 61/375,731 is incorporated herein.

TECHNICAL FIELD

Sliding windows and doors.

BACKGROUND

Sliding windows and doors include movable sashes and door panels configured to slide within corresponding frames. Removal of the sashes and door panels is desired at times for repair or cleaning of the sashes, door panels or the portion of the frame otherwise concealed by these features.

In some examples, sashes include tilt latches that slidably couple the sashes with frames during regular operation of a window. When removal of the sash is desired, a mechanism (e.g., a pin) is operated on the window to decouple a first end of the sash from the frame. The sash is then rotated out of the frame according to the tilting capability of the tilt latches that remain coupled at a second end of the sash. After rotation of the sash, the sash is pulled away from the tilt latches to fully decouple the sash from the frame. To facilitate tilting of the sash, tilt latches are localized at a single point on either side of the sash. Wind loads and the like applied to the sashes and transmitted to the frame are correspondingly transmitted as point loads the position of the tilt latches (and the pins holding the opposed end of the sash in place). Point loads create stress risers in the window and may deform the frame over the lifetime of the window. Further, point loads concentrate forces at the tilt latches and may cause failure of the tilt latches with attendant labor and repair part costs.

In other examples, frames include compression headers, frame parts having a groove therein with an elastomeric or spring biased feature between the compression header and the remainder of the frame. The sash or door panel is positioned within the frame in a near parallel orientation (to the frame). The compression header is deflected upward along its entire length to provide sufficient clearance for the sash or door panel, and the sash or door panel is thereafter seated in the frame. The compression header is released and engages along an edge of the sash or door panel. For installation and removal the entire compression header (e.g., along its length from one sash end to an opposed sash end) must be compressed to release the sash or door panel. Deflecting the compression header is difficult especially with wider windows and doors having correspondingly longer compression headers and sashes or door panels. Additionally, the compressive engagement of the compression header along the sash or door panel clamps the sash between two opposed portions of the frame and correspondingly increases the actuation force needed to slide the sash or door panel between open and closed positions.

BRIEF DESCRIPTION OF THE DRAWINGS

A more complete understanding of the present subject matter may be derived by referring to the detailed description and claims when considered in connection with the following illustrative Figures. In the following Figures, like reference numbers refer to similar elements and steps throughout the Figures.

Elements and steps in the Figures are illustrated for simplicity and clarity and have not necessarily been rendered according to any particular sequence. For example, steps that may be performed concurrently or in different order are illustrated in the Figures to help to improve understanding of examples of the present subject matter.

DESCRIPTION OF THE DRAWINGS

In the following detailed description, reference is made to the accompanying drawings which form a part hereof, and in which is shown by way of illustration specific examples in which the subject matter may be practiced. These examples are described in sufficient detail to enable those skilled in the art to practice the subject matter, and it is to be understood that other examples may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results.

Figure 1:
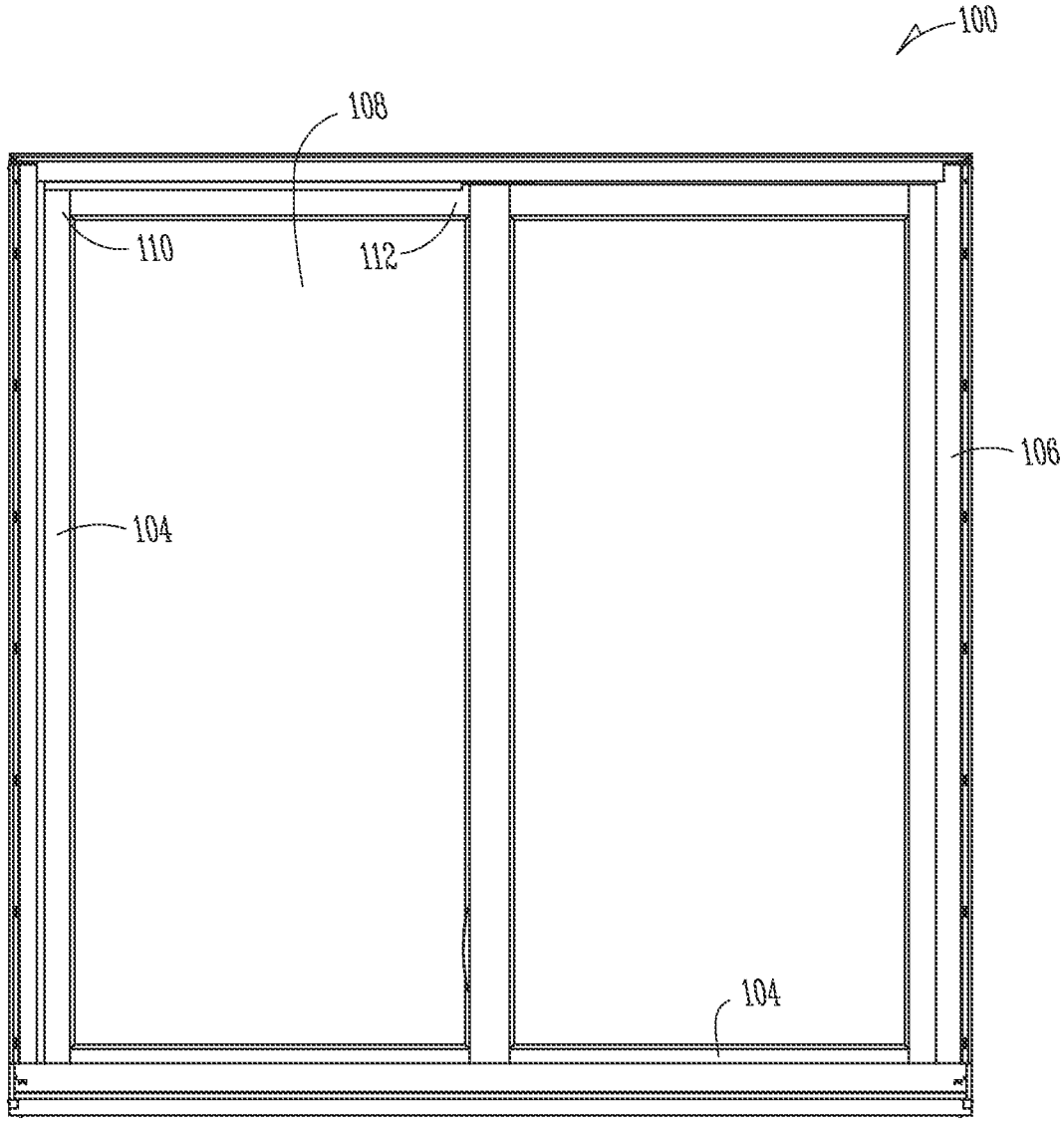
FIG. 1 is a front view of one example of a fenestration including, for instance, a door or a window.

FIG. 1 shows one example of a fenestration unit (or assembly) 100 including, for instance, a door or a window assembly. The fenestration unit 100 includes a frame 106 having a header, jambs and a sill extending over one or more sashes 104 (the term sashes 104 includes window sashes 104, door panels and the like) slidably received within the frame 106. For instance, the fenestration unit 100 includes, but is not limited to a sliding door assembly, a double hung window assembly and the like. As shown in FIG. 1, in one example, the sash 104 includes panes such as clear glass panes 108.

Figure 2:
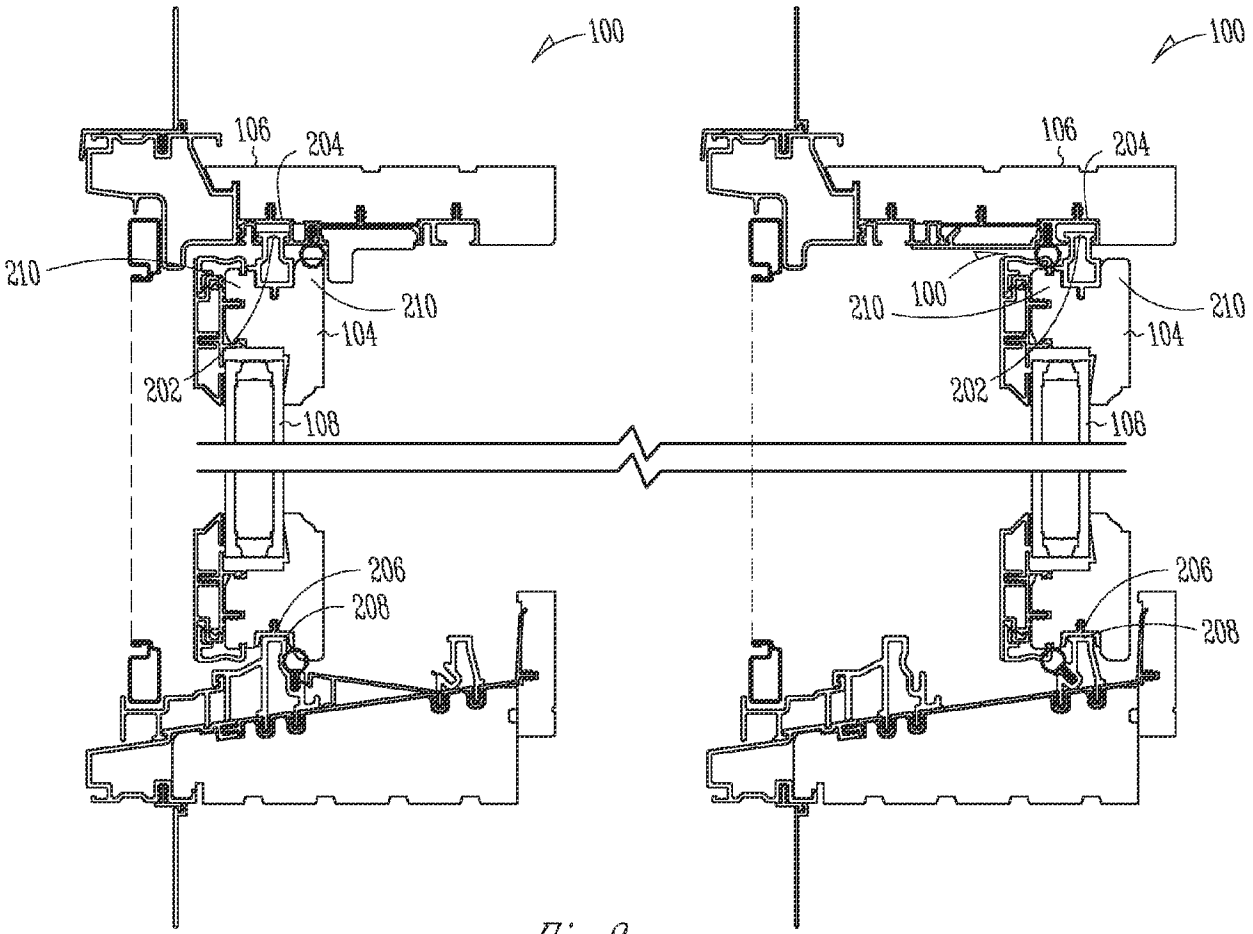
FIG. 2 shows dual cross-sectional views of the fenestration unit shown in FIG. 1 including a first sash and a second sash retained within a frame by a sash retainer bar assembly.

FIG. 2 shows a cross-sectional view of the fenestration unit 100 shown in FIG. 1. The fenestration unit 100 includes the frame 106 extending across the sashes 104 where the sashes 104 are slidably received within the fenestration unit 100 for movement to the left or right as shown in FIG. 1 (alternatively, up or down). As shown again in FIG. 2, the fenestration unit 100 includes a retainer bar fastener assembly 200 coupled between the sash 104 and the frame 106. Optionally, a retainer bar fastener assembly 200 is provided between each of the sashes 104 and the frame 106. In one example, the retainer bar fastener assembly 200 includes a sash retainer bar 202 sized and shaped for coupling between the sash 104 and the frame 106 of the fenestration unit 100. In another example, a retainer bar assembly includes the retainer bar fastener assembly 200 and the sash retainer bar 202 (e.g., the sash retainer bar 202 is not a part of the retainer bar fastener assembly 200). As shown, at least a portion of the sash retainer bar 202 is slidably received within a frame liner 204 affixed to the frame 106 of the fenestration unit 100. As the sash 104 is moved within the frame 106 the sash retainer bar 202 moves with the sash 104 and is slidably coupled within the frame liner 204 thereby ensuring that the sash 104 remains in an upright position throughout movement within the frame 106. The sash 104 further includes a track 206 sized and shaped to receive a runner 208 at the bottom of the frame 106. The runner 208 and the track 206 support the majority of the door weight in one example, and the sash retainer bar 202 maintains the sash 104 in an upright orientation substantially parallel to the exterior and interior planes of the frame 106.

As described in further detail below, the retainer bar fastener assembly 200 includes a hand operated mechanism sized and shaped for operation at a single location by a user where the sash 104 is in the open position to easily allow decoupling of the sash retainer bar 202 from the sash 104 and thereby facilitate removal of the sash 104 from the fenestration unit 100.

Figure 3A:
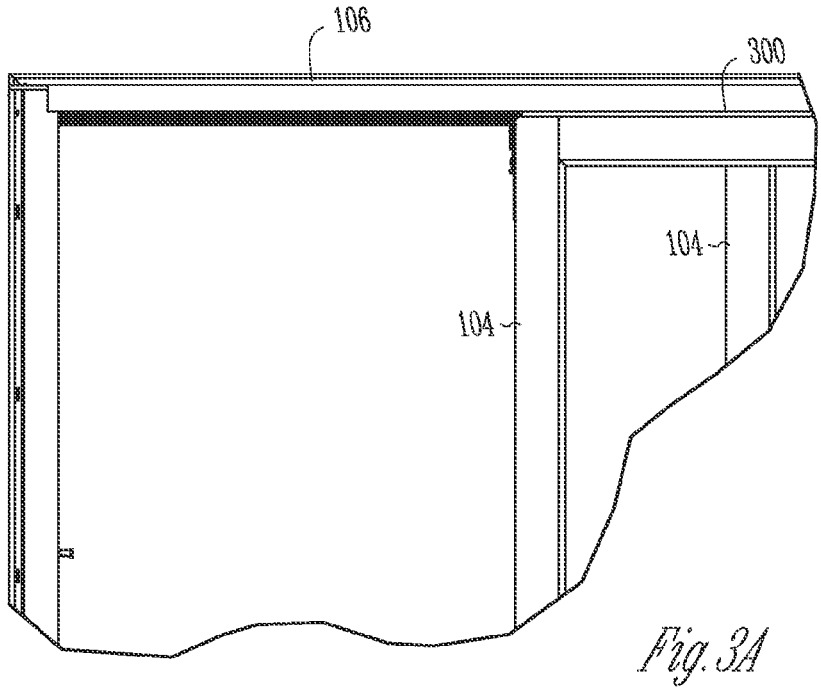
FIG. 3A shows a sash in an open position.

Referring now to FIG. 3A, the sash 104 is shown in a partially open configuration where at least one of the sashes 104 is slid to the right within the frame 106. As previously described above, the fenestration unit 100 includes a retainer bar fastener assembly 200 including a sash retainer bar 202 slidably coupled within a recess within the frame 106, for instance formed by the frame liner 204. Optionally, a retainer bar assembly includes the sash retainer bar 202 and the retainer bar fastener assembly 200 is configured to selectively fix and release the sash retainer bar 202 as described herein. As shown in FIG. 3A, the bar is coupled with the left most sash 104 and hidden between the sash and the frame 106. The bar is only visible through a small reveal 300 (e.g., shadow line) between the sash 104 and the frame 106, and is otherwise covered. Stated another way the bar is substantially concealed or hidden from view by the casual observer.

Figure 3B:
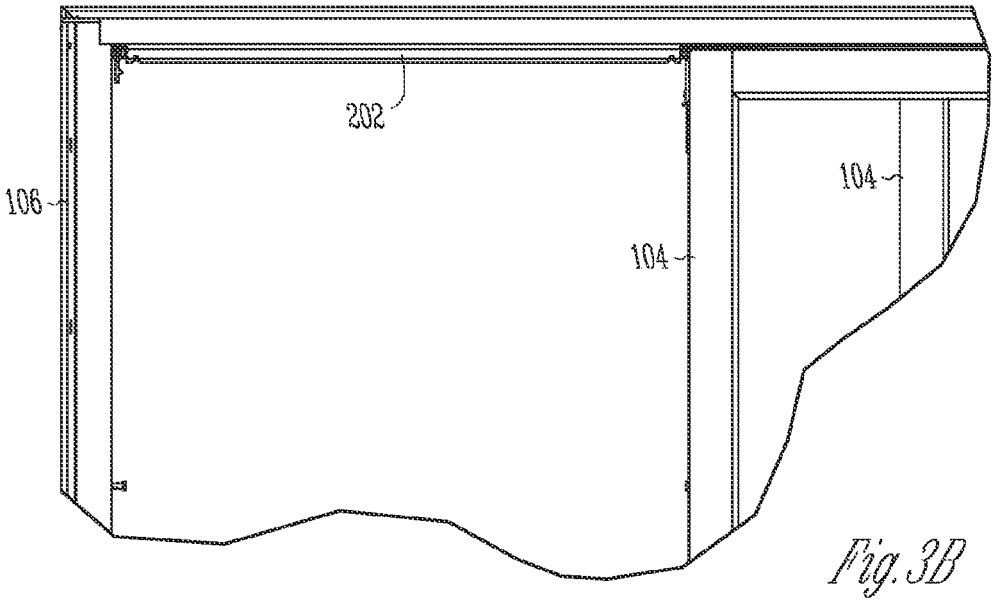
FIG. 3B shows the sash in an open position with the sash retainer bar removed from the sash.

As shown in FIG. 3B, the sash retainer bar 202 is in a decoupled position from the sash 104 positioned to the right. The retainer bar remains slidably coupled with the frame 106 and is positioned to the left. With the sash 104 slid to the right the sash retainer bar 202 is capable after a releasing operation of the retainer bar fastener assembly 200 to decouple and slide to the left of the frame 106. Decoupling of the sash retainer bar 202 from the sash 104 allows for tilting of the sash 104 outwardly (e.g., into or out of the page) white the bottom of the sash 104 remains coupled along the track 206 shown in FIG. 2 until removal therefrom. Removal of the sash 104 facilitates cleaning and maintenance of the frame 106 and facilitates cleaning and maintenance of the sash 104 in a more convenient setting, for instance, on the ground, on a table or the like.

Figure 4A:
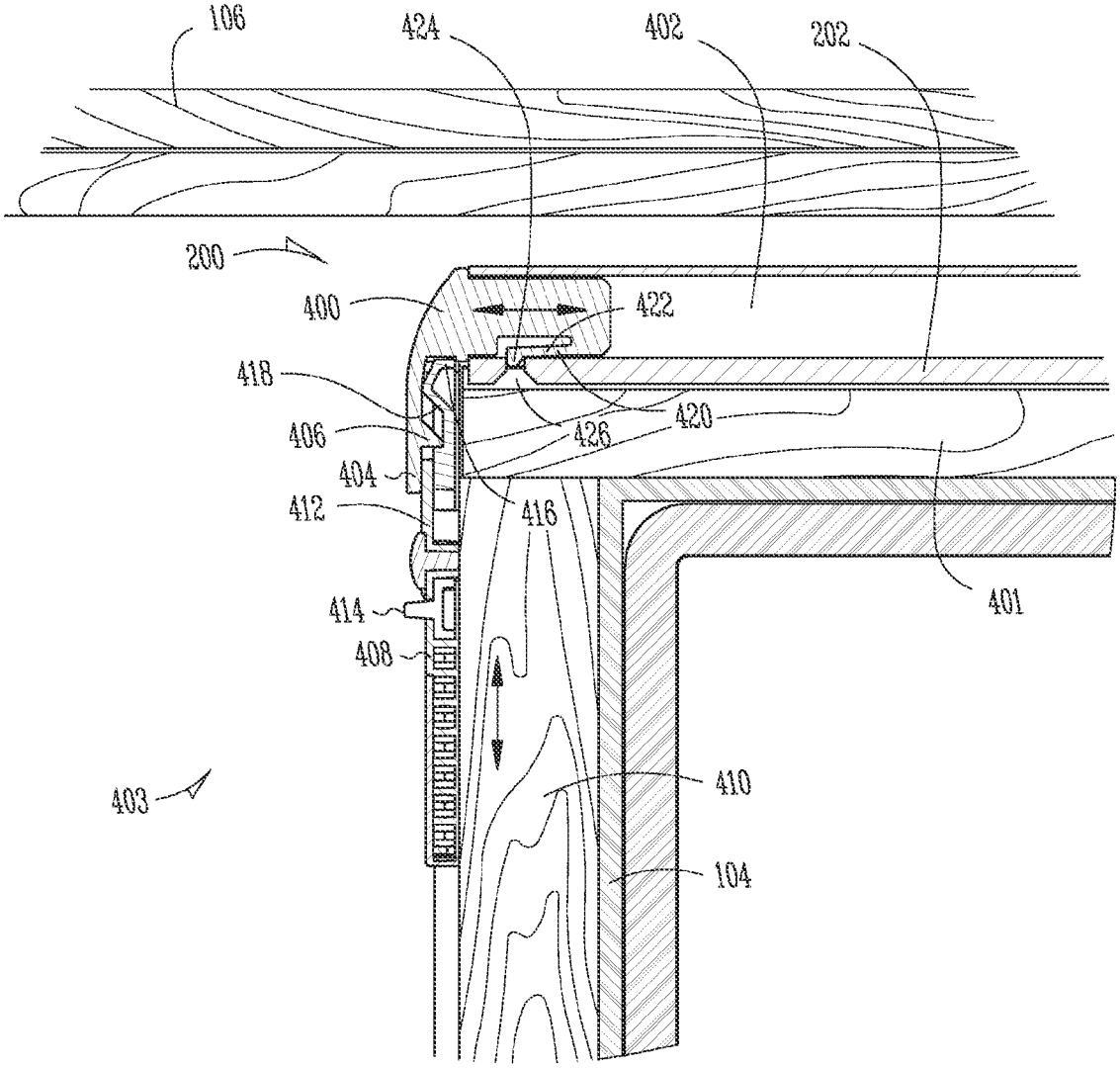
FIG. 4A is a detailed cross-sectional view of one of the sashes within the frame including the sash retainer bar and one example of a retainer bar fastener assembly.

FIG. 4A shows a detailed view of the retainer bar fastener assembly 200 with the sash retainer bar 202 coupled with the sash 104 and slidably received within the frame liner 204 (the liner is not shown in FIG. 4A because of the sectional view, see FIG. 2) of the frame 106. The retainer bar fastener assembly 200 includes the sash retainer bar 202, as previously described, and in one example further includes a retainer bar handle 400 received within a bar channel 402 of the sash retainer bar 202. In another example, a sash retainer bar assembly includes the sash retainer bar 202 and the retainer bar handle 400. As shown in FIG. 4A, the retainer bar handle 400 includes a handle projection (e.g., a handle bar 404) extending vertically along a portion of the sash 104 toward a follower surface 406. Optionally, the retainer bar handle 400 includes, but is not limited to, any sort of projection or gripping feature (e.g., knurling and the like) that facilitates grasping of the sash retainer bar 202 for installation and decoupling from the sash 104. In another example, the retainer bar handle 400 is integral to the sash retainer bar (e.g., molded, co-molded, machined as a single part and the like).

The retainer bar fastener assembly 200 further includes a retainer bar fastener such as movable bolt 408 slidably coupled along a stile 410 of the sash. The movable bolt 408 is held in place by a bolt housing 412 that facilitates sliding of the movable bolt 408 white at the same time retaining the movable bolt 408 along the stile 410 of the sash. As shown in FIG. 4A, the movable bolt 408 includes a pull tab 414 to provide easy actuation of the movable bolt 408 by a user when decoupling of the sash retainer bar 202 from the sash 104 is desirable.

In the fastening configuration shown in FIG. 4A, at least a portion of the movable bolt 408 is coupled with at least one of the sash retainer bar 202 and the retainer bar handle 400. In one example, the movable bolt 408 overlies a portion of the sash retainer bar 202 (e.g., an end of the bar) and thereby fixes the bar to the sash 104. Actual engagement of the movable bolt 408 to the sash retainer bar 202 or the retainer bar handle 400 occurs incidentally with operation of the sash 104 and bumping of the bar against the movable bolt 408. In another example, at least a portion of the movable bolt 408 is affirmatively engaged against one or more of the sash retainer bar 202 or the retainer bar handle 400 after the bar 202 is positioned in the installed orientation shown in FIG. 4A. Coupling of the movable bolt 408 with at least one of the sash retainer bar 202 and the retainer bar handle 400 thereby includes engagement or interference positioning without engagement being necessary to fix the sash retainer bar 202 relative to the sash 104 and prevent sliding movement therebetween.

In operation, where it is desired to decouple the sash 104 retainer bar from the sash 104 the user moves the sash 104 to an open position where a portion of the frame 106 capable of receiving the sash retainer bar 202 is exposed, for instance the area above where the sash 104 is normally disposed in a closed position. The user then reaches to the side of the sash 104 and pulls on the pull tab 414 thereby moving the movable bolt 408 in a downward direction relative to the remainder of the sash and the frame 106. Movement of the movable bolt 408 disengages an engaging surface 416 on the backside of the bolt from the sash retainer bar 202 thereby allowing the sash retainer bar 202 to freely slide out and away from the sash 104 and facilitate removal of the sash from the frame 106. Stated another way, movement of movable bolt 408 decouples the sash retainer bar 202 and the retainer bar handle 400 from an installed fixed position along the sash 104 and allows the sash retainer bar 202 and the retainer bar handle 400 to freely slide out from between the sash 104 and the frame 106. Transitioning of the movable bolt 408 into the releasing configuration and sliding of the sash retainer bar 202 are both performed with convenient operations localized at the retainer bar fastener assembly 200. Labor intensive lifting of the entire sash (or door panel) to compress and entire compression header extending the length of a sash or door panel is thereby avoided. Similarly, the operation of a plurality of tilt latches is avoided and the releasing of the sash 104 from the frame 106 is performed at the single retainer bar fastener assembly 200.

To assist in sliding of the sash retainer bar 202 the movable bolt 408 includes, in one example, a camming surface 418 having a taper sized and shaped to engage with the corresponding follower 406 on the retainer bar handle 400. As shown in FIG. 4A, the follower 406, in one example, is included with the handle bar 404 extending from the remainder of the retainer bar handle 400. Engagement of the camming surface 418 with the follower 406 pushes the handle bar 404 in an opposed direction, for instance, toward the open portion of the frame 106 and thereby slides the sash retainer bar 202 coupled with the retainer bar handle 400 outwardly and away from the sash. The user may thereafter grab the retainer bar handle 400 and pull the remainder of the bar out of engagement with the sash 104 to decouple the sash retainer bar 202 from the sash 104 and allow removal of the sash 104 from the fenestration unit 100. In one example, the handle projection (e.g., the handle bar 404) extends into a frame opening 403 of the frame 106 while the sash 106 is in at least a partially open configuration as shown in FIG. 4A. Stated another way, the handle projection is exposed and accessible because it extends into the opening and is not otherwise retained within the frame members or between the frame 106 and the sash 104.

In another example shown in FIG. 4A, the retainer bar fastener assembly shows the retainer bar handle 400 including an anchor 420 such as a deflectable arm 422 having a tab 424 received within a bar recess 426 of the sash retaining bar 202. The deflectable arm 422 and the tab 424 fix the retainer bar handle 400 to the sash retainer bar 202. In other examples, the sash retainer bar 202 and the retainer bar handle 400 include other features configured to couple the bar with the handle including, but not limited to, interference fittings, mechanical fittings such as pins and screws, welds, adhesives and the like.

Referring again to FIG. 4A, arrows are provided on the retainer bar handle 400 and the sash retainer bar 202 in a left to right direction to show movement of the bar, sash and the like, and upward and downward arrows are provided adjacent to the movable bolt 408, respectively to show movement of the bolt relative to the bar, retainer bar handle 400 and the like. As previously described, vertical movement of the bolt, for instance, in a downward direction disengages the engaging surface 416 (e.g., engaging or overlying surface) from the sash retainer bar 202 and allows right to left movement of the sash retainer bar 202 out of the sash. Stated another way, the movable bolt 208 moves from a fastening configuration to a releasing configuration. Engagement of the camming surface 418 with the follower 406 correspondingly pushes the retainer bar handle 400 and the coupled sash retainer bar 202 out of a portion of the sash 104 and allows the operator to easily grab the bar (for instance by the retainer bar handle 400) and thereafter pull the bar out of engagement with the sash to allow for tilting movement of the sash out of the fenestration unit 100.

Figure 4B:
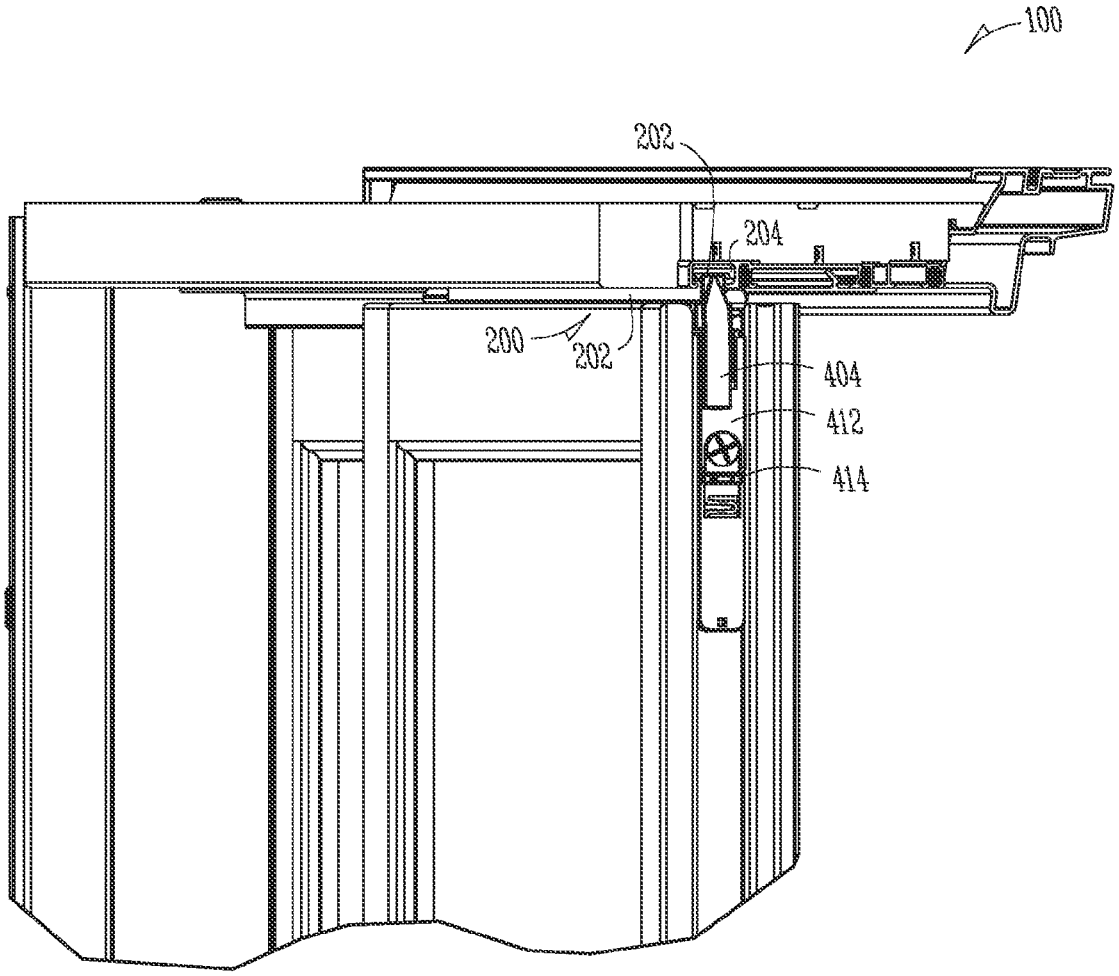
FIG. 4B is a detailed cross-sectional view of a fenestration unit exposing the sash retainer bar and the retainer bar fastener assembly shown in FIG. 4A taken along a plane perpendicular to the plane of the fenestration unit.
Figure 5:
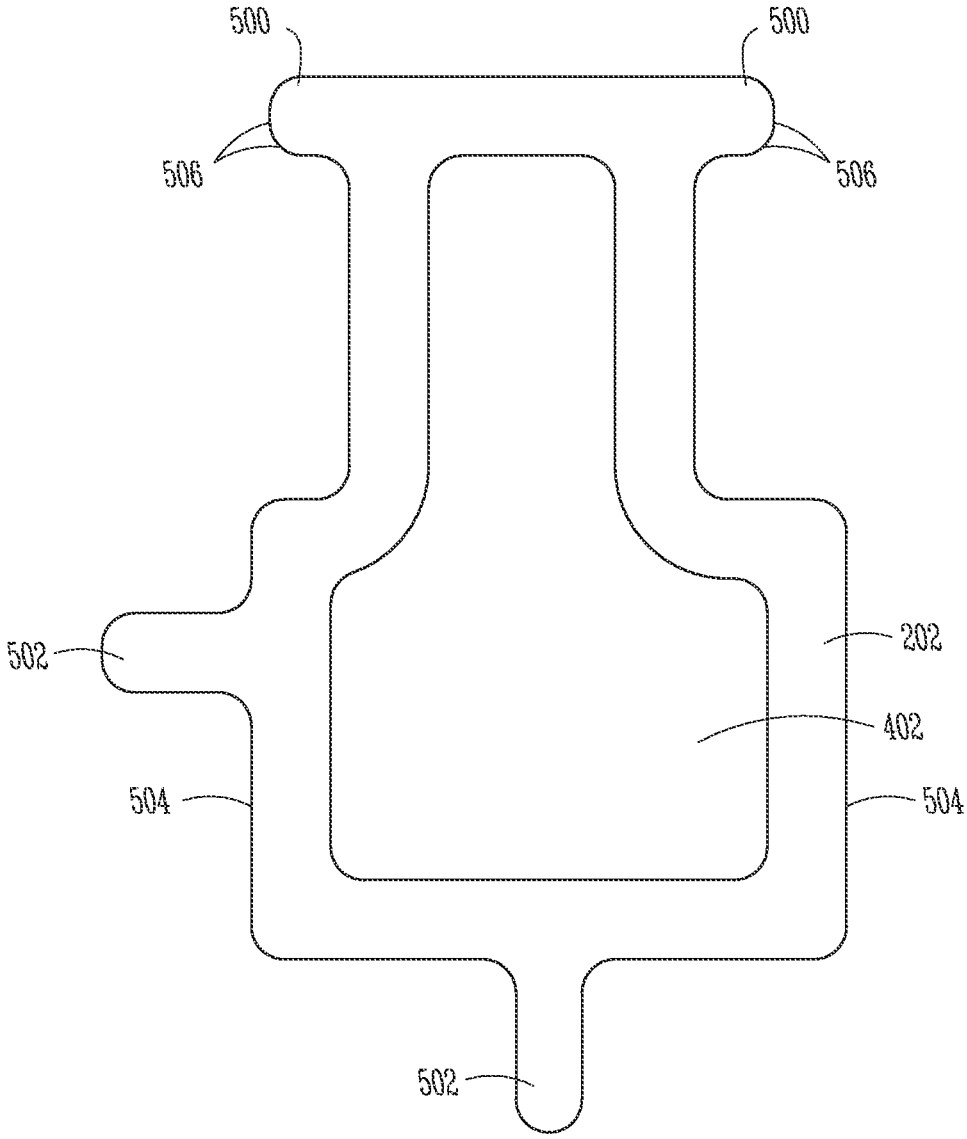
FIG. 5 is an end view of a sash retainer bar usable with the fenestration unit described herein.
Figure 6B:
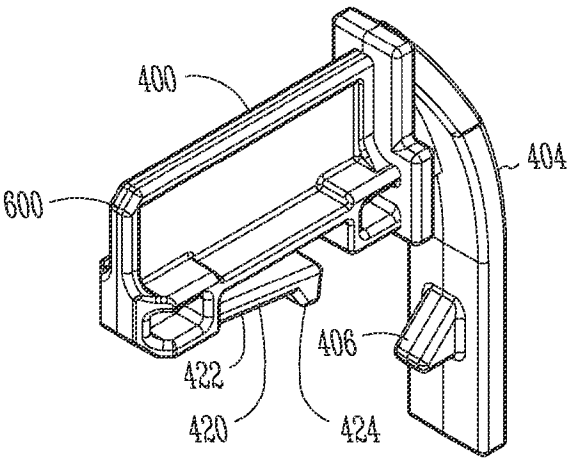
FIG. 6 shows a plurality of views of the retainer bar handle sized and shaped for coupling with the sash retainer bar.
Figure 6E:
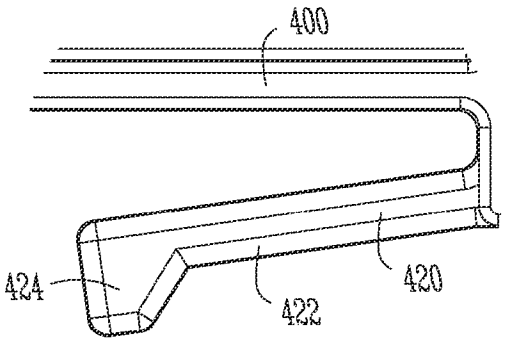
Figure 6C:
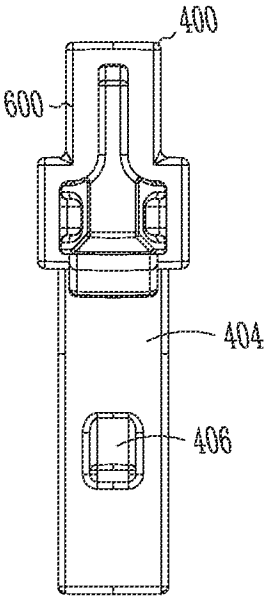
Figure 6A:
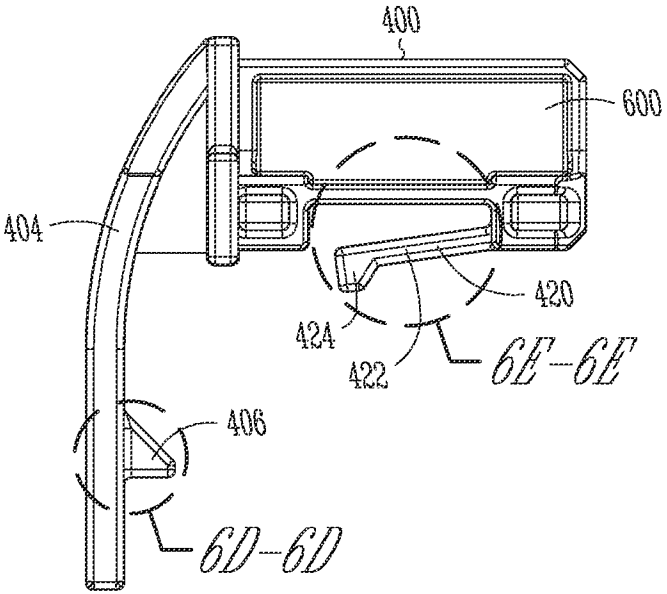
Figure 6D:
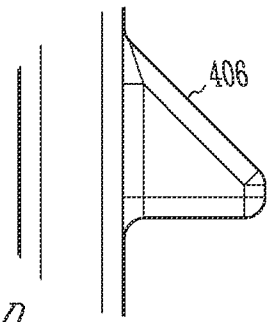

FIG. 4B shows another view of the retainer bar fastener assembly 200. In this view a cross-sectional cut is taken in a plane perpendicular to the plane of the fenestration unit 100. For instance, the handle bar 404 and sash retainer bar 202 are shown in a coupled orientation within the frame liner 204 of the frame 106. The bolt housing 412 is shown along with the pull tab 414 of the movable bolt 408 projecting through an orifice within the bolt housing 412. FIG. 5 shows one example of the sash retainer bar 202 previously described herein. As shown, the sash retainer bar 202 includes glider tabs 500 sized and shaped for engagement with corresponding portions of the frame liner described below. The glider tabs 500 facilitate sliding movement of the bar and thereby the sash 104 attached thereto relative to the frame 106. In the example shown in FIG. 5, the sash retainer bar 202 further includes engagement pins 502 (e.g., elongate ridges extending the length of the bar or pins and ridges that are localized at points along the bar) sized and shaped for reception within corresponding portions of the sash. The engagement pins 502 ensure that the sash retainer bar 202 is fully coupled with the sash 104 and thereby capable of retaining the sash in an upright position when subject to force loads such as wind loading at a normal direction relative to the fenestration unit 100 sashes 104 or door panels. In another example, the engagement pins 502 are slidably coupled with the sash 104 and thereby facilitate sliding movement of the sash retainer bar 202 when released by the retainer bar fastener assembly 200 (e.g., the movable bolt 208). The sash retainer bar 202 shown in FIG. 5 further includes sash engaging surfaces 504 and frame engaging surfaces 506. The sash engaging surfaces 504 are configured for coupling with the sash flanges 210 shown in FIG. 2. The frame engaging surfaces 506 are configured for coupling with frame flanges 706 (shown in FIG. 7) along the frame liner 204. As described below, the engagement between the elongate sash retainer bar 202 (having a retainer bar length), the sash 104 and the frame 106 between locations near the first and second ends 110, 112 (See FIG. 1) of the sash 104 provides a continuous interface according to the elongate retainer bar length between the sash 104 and the frame 106 to distribute and transmit forces incident to the sash 104 without point loads. Because the sash retainer bar 202 extends along a portion of the sash, such as the full length, the sash retainer bar 202 eliminates point loading otherwise possible with tilt latches and the like. For instance, the sash retainer bar 202 extends continuously between first and second locations near the first and second ends 110, 112 of the sash 104. The continuous extension of the sash retainer bar 202, including an unbroken or partially broken sash retainer bar length (e.g., with one or more gaps, recesses and the like) provides a corresponding continuous interface between the frame 106 and the sash 104. With the continuous interface toads including wind toads, physical pressure (from animals, children and burglars) and the like incident on the sash 104 are transmitted throughout the length of the sash retainer bar 202 to the frame 106 by one or more of the engagement pins (e.g., ridges), the sash engaging surfaces 504, the frame engaging surfaces 506 and the corresponding parts of the frame 106 and the sash 104. For example, the sash retainer bar 202 includes sash surfaces configured for engagement with sash flanges of the sash, and frame surfaces of the sash retainer bar 202 are configured for engagement with the surfaces of the frame liner 204. The sash 104 or door panel is thereby reliably retained within the frame 106 despite the application of these forces. Further, point stresses for instance at tilt latches and the like are avoided thereby minimizing the possibility of failure and the need for repair.

Further, the engagement pins facilitate easy decoupling of the sash retainer bar 202 from the corresponding portions of the sash 104 when the retainer bar fastener assembly 200 is operated as previously described herein. Stated another way the user is able to easily slide the sash retainer bar 202 relative to the sash 104 after operation of the retainer bar fastener assembly 200 to easily decouple the bar from the sash 104 and thereby allow easy tilting movement of the sash 104 and removal of the sash from the frame 106.

FIGS. 6A-E show a plurality of views of the retainer bar handle 400 previously described and shown in FIGS. 4A, 4B. The retainer bar handle 400 includes a retainer body 600 sized and shaped for reception within a bar channel 402 of the sash retainer bar 202. In one example, the retainer bar handle 400 includes an anchor 420 with a deflectable arm 422 sized and shaped for reception within a recess of the sash retainer bar 202. Engagement of the anchor 420 within the recess of the sash retainer bar 202 fixes the retainer bar handle 400 with the sash retainer bar 202 and ensures that movement of the retainer bar handle 400, for instance, sliding movement within the frame 106 is correspondingly transmitted to the sash retainer bar 202. A handle bar 404 extends from the retainer body 600 toward a follower 406 as shown in FIG. 6. The follower 406, as previously described, is sized and shaped for engagement with a camming surface 418 on the movable bolt 408. Camming along the follower 406 ensures that the retainer bar handle 400 and the sash retainer bar 202 coupled thereto are slid out of at least a portion of the sash 104 from an installed configuration thereby allowing access by a user to the retainer bar handle 400 and further sliding movement of the bar and retainer bar handle 400 according to user provided motion. As described above, sliding the sash retainer bar 202 from between the sash 104 and the frame 106 facilitates the tilting removal of the sash 104.

Figure 7:
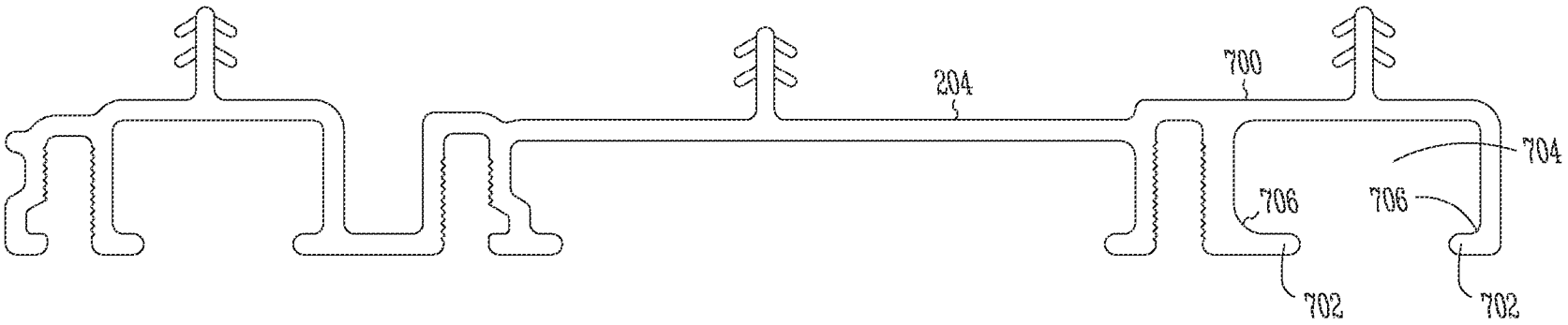
FIG. 7 shows one example of a frame liner sized and shaped for coupling with the fenestration unit frame and slidable coupling with the sash or door panel.

FIG. 7 shows one example of a frame liner 204 sized and shaped for coupling with a frame 106, for instance a header or jamb. As shown the frame liner 204 includes a frame mounting surface 700 sized and shaped for coupling with a portion of the frame 106. The frame liner 204 further includes liner rails 702 sized and shaped to slidably engage with glider tabs 500 of the sash retainer bar 202. As previously described herein, slidable coupling between the liner rails 702 and the glider tabs 500 ensures slidable movement between the sash retainer bar 202 and the frame liner 204 and thereby ensures slidable movement of the sash 104 or door panel relative to the frame 106. The frame liner 204 further includes a liner channel 704 sized and shaped to receive a portion of the sash retainer bar 202 including the glider tabs 500. The frame liner further includes liner flanges 706 sized and shaped to engage with corresponding frame engaging surfaces 506 of the sash retainer bar 202. In one example, the liner flanges 706 are at least substantially coextensive with the sash length, and thereby cooperatively maintain the continuous interface between the sash 104, the sash retainer bar 202 and the frame 106 between the first and second sash ends 110, 112.

Figure 8B:
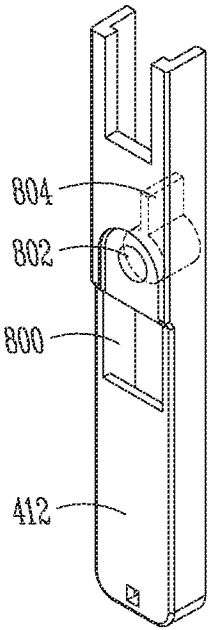
FIG. 8 shows a plurality of views of a bolt housing sized and shaped for reception of a movable bolt.
Figure 8A:
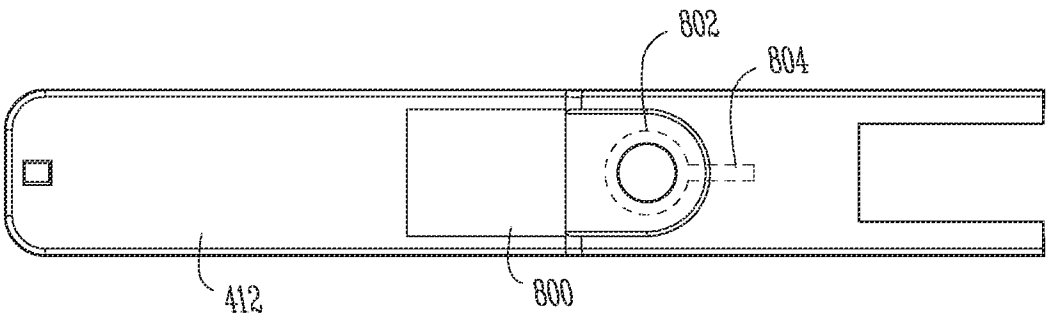

FIG. 8 shows a plurality of views of the bolt housing 412 previously described and shown in FIGS. 4A, B. The bolt housing 412 is sized and shaped to extend over a portion of the movable bolt 408 and retain the movable bolt 408 along the corresponding component 410 (e.g., a stile or rail) of the sash 104 or door panel. As shown in FIG. 8, the bolt housing 412 includes, in one example, a pull tab orifice 800 sized and shaped to pass the pull tab 414 of the movable bolt 408 therethrough to allow access by a user and operation of the movable bolt 408. In the example shown in FIG. 8, the bolt housing 412 further includes a bolt retaining pin 802 sized and shaped for reception within a corresponding channel within the movable bolt 408 to ensure that the movable bolt 408 moves within a specified range of motion. Optionally, the bolt housing 412 includes a support projection 804 extending within the interior of the bolt housing 412 to provide additional support, for instance as the bolt housing 412 is pushed into engagement between the frame 106 and the sash 104 (during closing of the sash 104). In one example, the bolt housing 412 is integrally formed with the sash 104 or door panel. In another example, the bolt housing 412 is formed separately and thereafter coupled to the sash 104 or door housing with nails, screws, mechanical interfittings and the like.

Figure 9B:
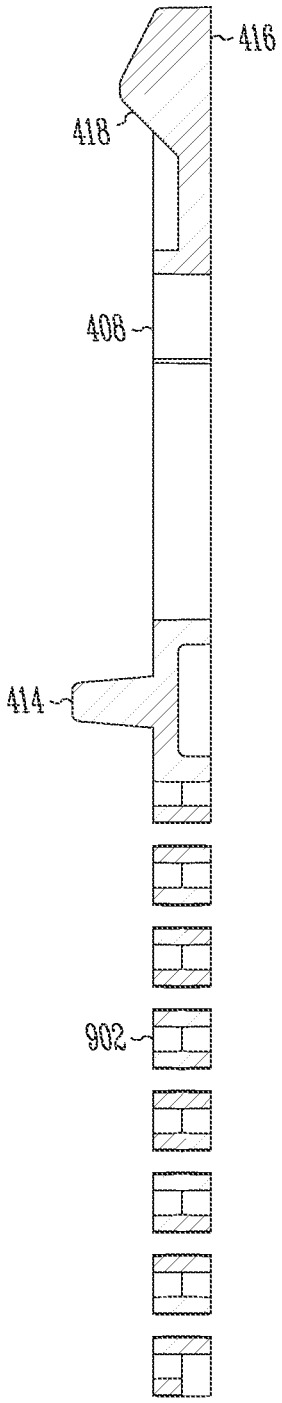
FIG. 9B shows a cross-sectional view of the movable bolt shown in FIG. 9A taken along 9B-9B.
Figure 9A:
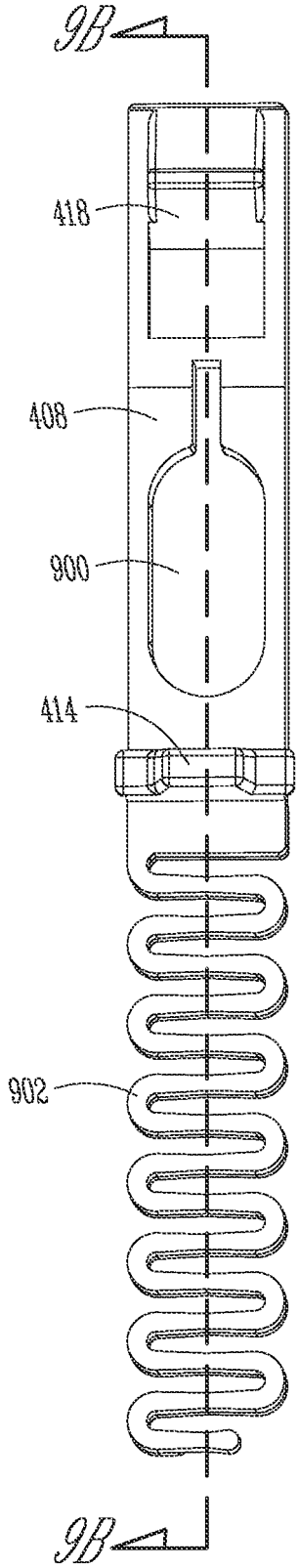
FIG. 9A shows a perspective view of one example of a movable bolt sized and shaped for coupling with the sash or door panel for selective coupling with the sash retaining bar.

FIG. 9 shows one example of a movable bolt 408 for use with the retainer bar fastener assembly 200 described herein. As previously described, the movable bolt 408 includes a camming surface 418 and an engagement surface. The engaging surface 416 is sized and shaped to engage with an end of the bar and substantially prevent movement of the bar relative to the sash. Stated another way, the engaging surface 416 cooperates with the remainder of the sash 104 to retain the bar in an orientation consistently above the sash 104 and thereby maintain the sash within the frame 106 without allowing tilting motion of the sash therefrom. Put another way, the engaging surface 416 ensures that the sash retainer bar 202 remains fixedly coupled with the sash 104 and slidably coupled with the frame 106 throughout movement of the sash 104 within the fenestration unit 100. Optionally, seating of the engaging surface 416 so it overlies the sash retainer bar 202 as shown without actual engagement substantially prevents movement of the sash retainer bar 202 relative to the sash 104. As described above, when disengagement of the sash 104 is desired the movable bolt 408 is moved away from the sash retainer bar 202 and the camming surface 418 of the movable bolt 408 engages with the corresponding portion of the retainer bar handle 400 including the follower 406. This engagement forces the bar to move away from the sash 104 and thereby allows further movement by an operator capable of grabbing the bar after it is projected partially away from the sash.

As shown in FIG. 9, the movable bolt 408 in this example includes a pin channel 900 sized and shaped to receive the bolt retaining pin 802 (and the optional support projection 804) shown in FIG. 8. Reception of the bolt retaining pin 902 within the pin channel 900 ensures that the movable bolt 408 is movable throughout a desired range of motion including a fastening configuration a fully engaged position) where the engaging surface 416 is positioned over at least a portion of the end of the bar assembly and a releasing configuration (e.g., a disengaging orientation or position) where the movable bolt 408 engaging surface 416 is out engagement or coincidence with the sash retainer bar 202 thereby allowing slidable movement of the sash retainer bar 202 relative to the sash 104 for decoupling of the sash 104 from the frame 106.

To ensure the movable bolt 408 by default remains in an engaging orientation with the sash retainer bar 202 the movable bolt 408 in the example shown in FIG. 9 includes a biasing element 902, such as a spring, sized and shaped to bias the engaging surface 416 into coupling (positioned to intercept the sash retainer bar 202 or an actual engaging orientation) with the sash retainer bar 202. Although engagement between the engaging surface 416 and the sash retainer bar 202 has been described herein by engagement it is intended to also mean that the engaging surface 416 of the movable bolt 408 is moved into a position overlaying the end surface of the sash retainer bar 202. Actual engagement between the engaging surface 416 and the sash retainer bar 202 is not necessary for retention of the sash retainer bar 202 between the sash 104 and the frame 106.

To construct the retainer bar fastener assembly 200 and the corresponding fenestration unit 100 herein the retainer bar fastener assembly 200 is formed through a combination of one or more of molding, metal bending, injection molding and the like. Thereafter the retainer bar fastener assembly 200 is assembled to the fenestration unit 100 having a properly configured sash retainer bar 202 and corresponding flame liner 204 extending along the frame 106 of the fenestration unit 100.

Figure 10A:
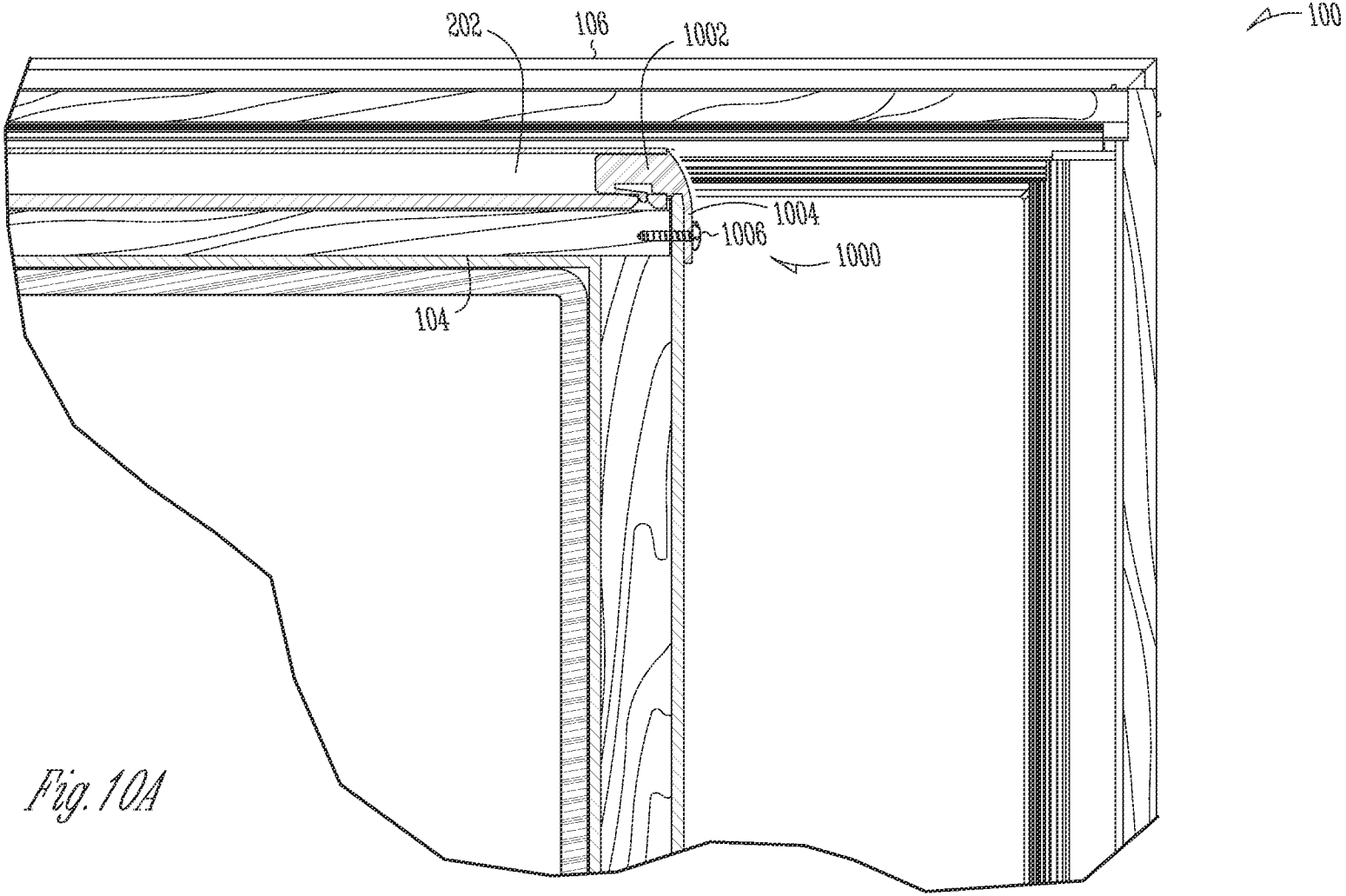
FIG. 10A shows a detailed cross-sectional view of the sash retainer bar and another example of a retainer bar fastener assembly in a fenestration assembly.
Figure 10B:
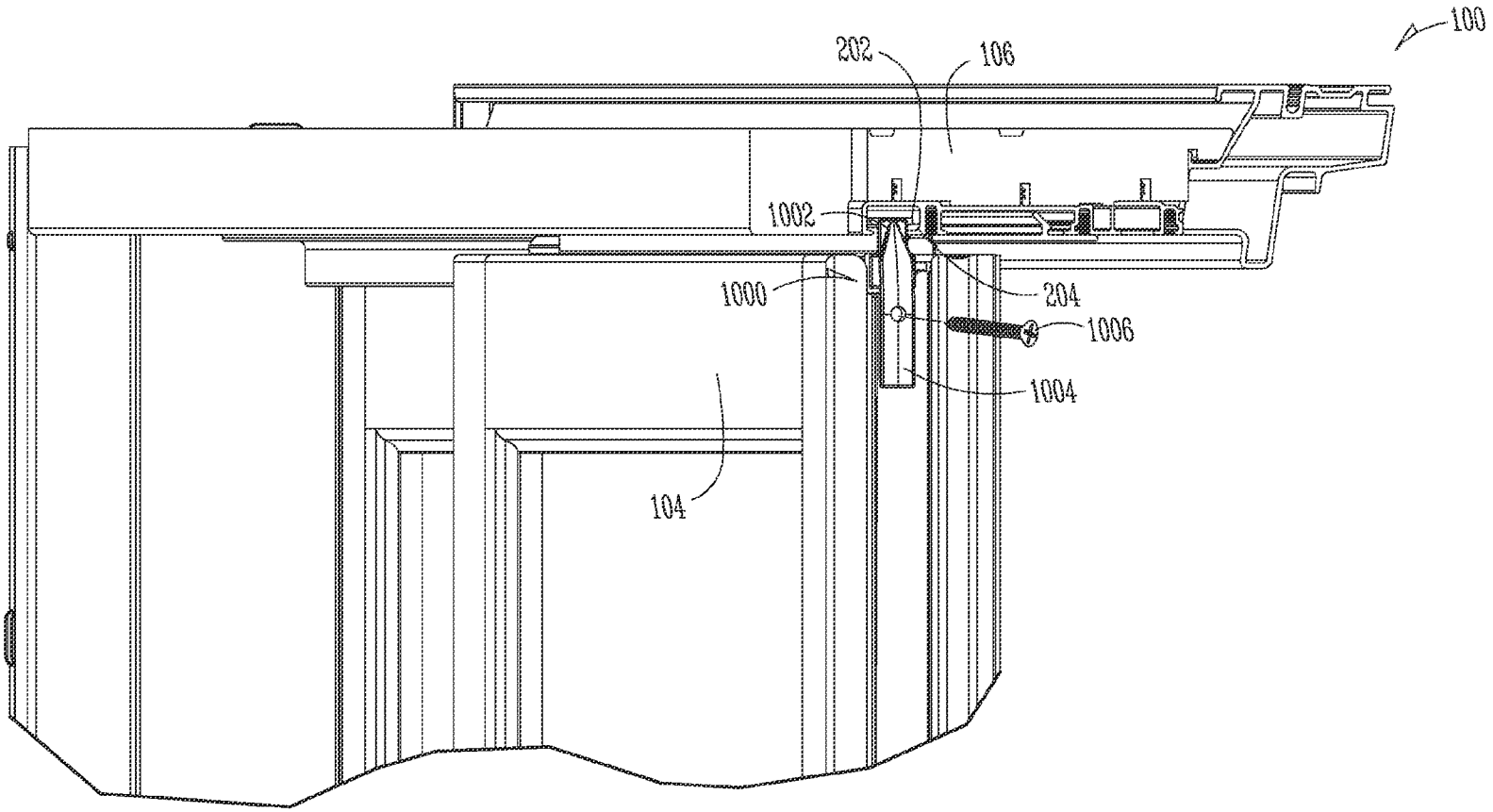
FIG. 10B shows a detailed cross-sectional view of a fenestration unit exposing the sash retainer bar and the retainer bar fastener assembly shown in FIG. 10A taken along a plane perpendicular to the plane of the fenestration unit.

FIGS. 10A and 10B show another example of a fenestration assembly 100 including retainer bar assembly including the sash retainer bar 202 and a retainer bar fastener assembly 1000. The fenestration assembly 100 is similar in at least some regards to the previously described fenestration assembly shown herein. For instance, the fenestration assembly 100 includes a frame 106 and one or more sashes 104 slidably received within the frame 106. Further, as shown in FIG. 10A, a sash retainer bar 202 is coupled between the sash 104 and the frame 106. For instance, the sash retainer bar 202 is fixably coupled to the sash 104 in a fastening configuration to facilitate slidably movement between the frame 106 and the assembly of the sash retainer bar 202 and the sash 104 according to the coupling provided by the retainer bar fastener assembly 1000.

Referring now to FIG. 10A, the retainer bar fastener assembly 1000 is shown in a fastening configuration where the retainer bar fastener assembly fixably couples the sash retainer bar 202 with the sash 104, for instance during regular operation of the fenestration assembly 100. The retainer bar handle 1002 is coupled with the sash retainer bar 202. As described in previous examples, the retainer bar handle 1002 shown in FIG. 10A includes a handle bar 1004 (e.g., a handle projection) extending away from the remainder of retainer bar handle 1002, for instance into the viewable portion of the fenestration assembly 100 outside of the frame 106 while the sash 104 is in an open or at least partially open configuration such as the partially open configuration shown in FIG. 10A. The retainer bar fastener assembly 1000 includes a pin 1006 extending between the retainer bar handle 1002 and the sash 104. The pin 106 is included as a retainer bar fastener for the retainer bar fastener assembly 1000. As shown in FIG. 10, the pin 1006 fixably couples the retainer bar handle 1002 with the sash 104 thereby similarly fixing the sash retainer bar 202 with the sash 104. The sash retainer bar 202 in the fastening configuration is thereby held static relative to the sash 104 while being slidably moveable relative to the frame 106 during sliding of the sash 104.

Referring now to FIG. 10B, the fenestration assembly 100 including the retainer bar fastener assembly 1000 is shown again. In the view shown in FIG. 10B, the fastener 1006 is shown in an exploded view with the fastener decoupled from the retainer bar handle 1002 and the sash 104. In this configuration, the retainer bar handle 1002 is coupled with the sash retainer bar 202 and the sash retainer bar is free to slide relative to the sash 104. For instance, a user may grasp the retainer bar handle 1002, such as at the handle bar 1004, and slidably move the sash retainer bar 202 and the retainer bar handle 1002 out of engagement between the frame 106 and the sash 104. As previously described the slidable decoupling of the sash retainer bar 202 (otherwise continuously interfaced between the sash 104 and the frame 106) allows for tilting of the sash 104 within the frame 106 of the fenestration assembly 100. After the sash 104 is tilted out of a substantially parallel orientation to the remainder of the frame 106, the operator may lift the sash 104 relative to the frame 106 and fully decouple the sash 104 from the frame 106 to facilitate maintenance, cleaning, and the like. In some examples the retainer, bar fastener, including the pin 1006, includes but is not limited to a pin such as a cotter pin, screw, post having a head with a larger diameter and the like configured to retain one or more of the retainer bar handle 1002 or the sash retainer bar 202 against a portion of the sash 104.

Figure 11A:
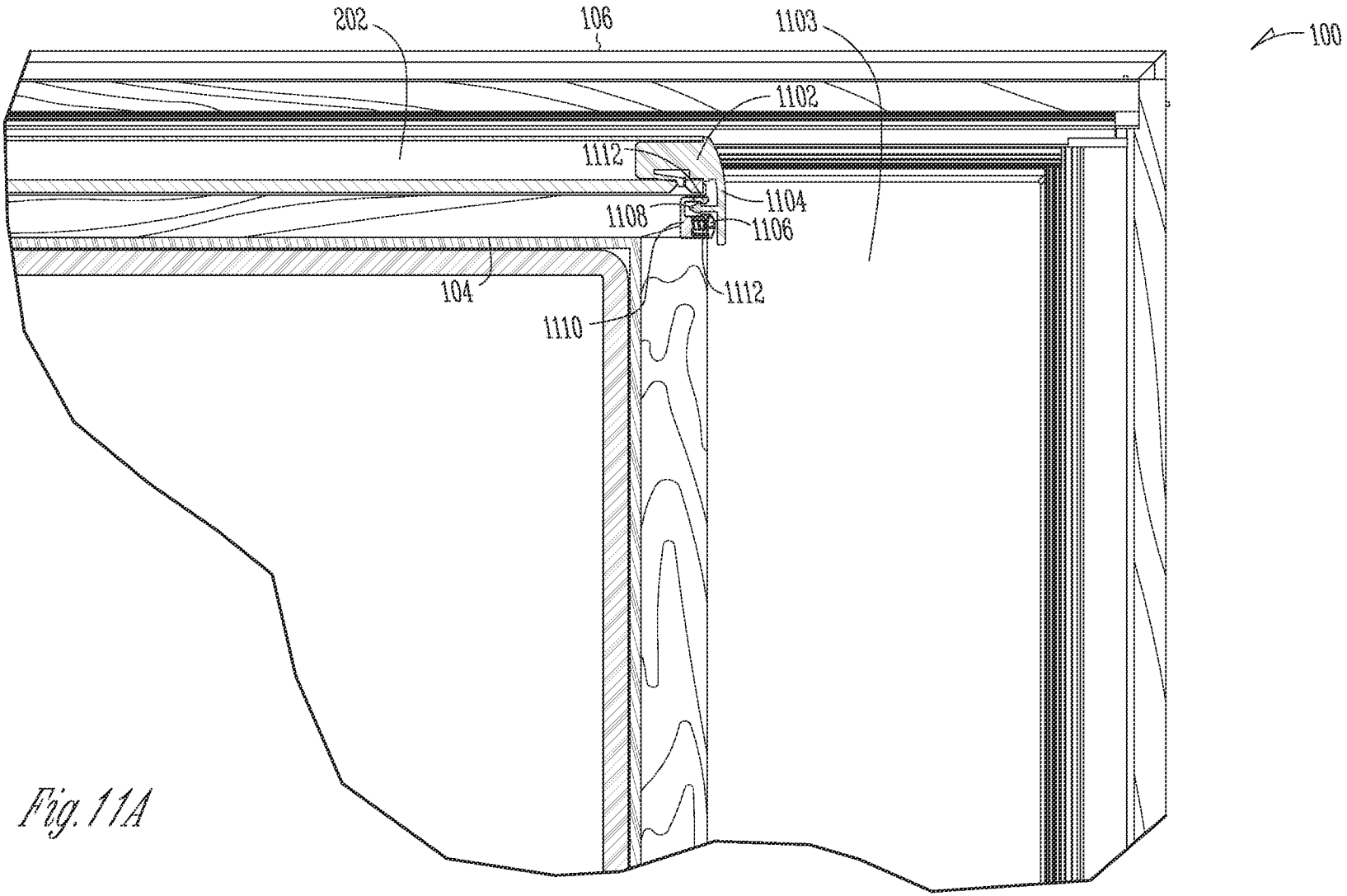
FIG. 11A shows a detailed cross-sectional view of the sash retainer bar and yet another example of a retainer bar fastener assembly in a fenestration assembly.
Figure 11B:
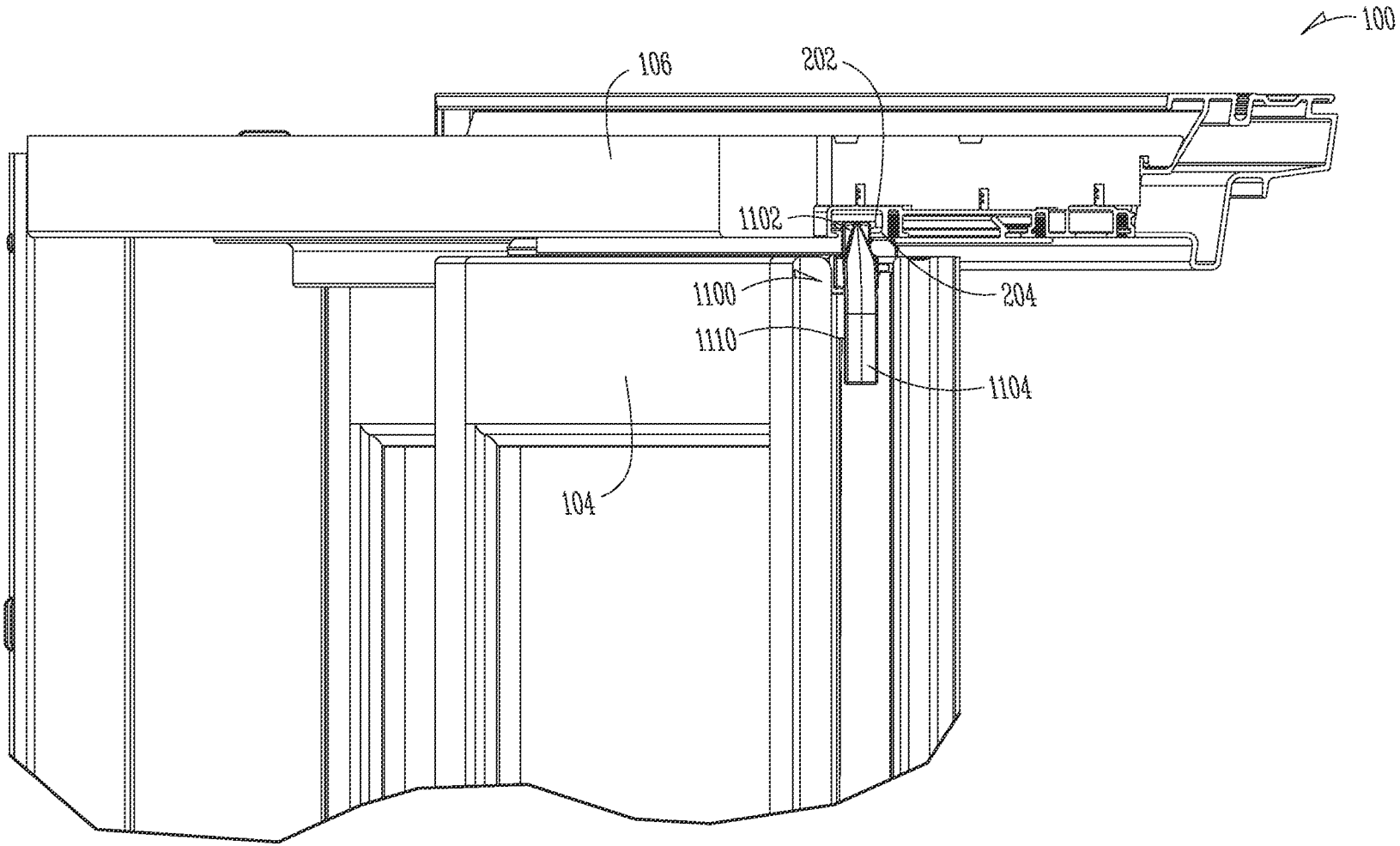
FIG. 11B shows a detailed cross-sectional view of a fenestration unit exposing the sash retainer bar and the retainer bar fastener assembly shown in FIG. 11A taken along a plane perpendicular to the plane of the fenestration unit.

FIGS. 11A and 11B show yet another example of a fenestration assembly 100 including another embodiment of a retainer bar assembly including the sash retainer bar 202 and a retainer bar fastener assembly 1100. As with the previous fenestration assemblies 100 previously described herein, the fenestration assembly 100 including a retainer bar fastener assembly 1100 includes at least some features similar to the previously described examples. For instance, the fenestration assembly 100 includes a frame 106 extending around one of more sashes 104 slidably coupled within the frame 106. Additionally, the fenestration assembly includes a sash retainer bar 202 configured for selective slidable coupling between the sash 104 and the frame 106.

As shown in FIG. 11A, a retainer bar handle 1102 is coupled with the sash retainer bar 202. The retainer bar handle 1102 presents a handle bar 1104 extending away from the remainder of the retainer bar handle 1102. For instance, in one example the handle bar 1104 (e.g., handle projection) extends into a frame opening 1103 formed by the frame (e.g., the open space of the frame surrounded by the frame members) white the sash is in at least a partially open configuration as shown in FIG. 11A.

Referring again to FIG. 11A, the retainer bar fastener assembly 1100 is shown. The retainer bar fastener assembly 1100 includes a detent projection 1106 coupled with at least one the retainer bar handle 1102 or the sash 104. Additionally, the retainer bar fastener assembly 1100 includes a detent seat 1110 coupled with the other of the sash 104 or the retainer bar handle 1102. As shown in FIG. 11A, in one example the detent projection 1106 includes a flared end 1108 configured for reception within the detent seat 1110. As further shown in FIG. 11A, the detent seat 1110 includes one or more deformable seat arms 1102 extending around the flared end 1108 of the detent projection 1106 while the retainer bar fastener assembly 110 is in the fastening configuration. The retainer bar fastener assembly 1100 with the detent projection 1106 received within the detent seat 1110 substantially prevents the relative movement of the sash retainer bar 202 relative to the sash 104. Stated another way, the sash retainer bar 202 moves with the sash member 104 as a single unit while the fastening configuration is maintained during translation of the sash 104 within the frame 106. That is to say, the sash retainer bar 202 is fixed relative to the sash member 104 in the fastening configuration. In the releasing configuration with the detent projection 1106 decoupled from the detent seat 1110 the sash retainer bar 202 is free to move (e.g., slide) relative to the sash 104.

Referring now to FIG. 11B, the retainer bar fastener assembly 1100 is shown again in the fastening configuration. For instance, the sash retainer bar 202 is received between the sash 104 and a frame liner 204 of the frame 106. As previously described, the sash retainer bar 202 is configured to slide relative to the frame liner 204 during normal operation of the sash 104 within the fenestration assembly 100. When decoupling of the sash 104 from the frame 106 is desired an operator grasps the bar handle 1104 and applies pressure to the bar handle 1104 to pull it away from the sash 104. The deformable seat arms 1112 shown in FIG. 11A deflect away from the flared end 1108 thereby releasing the detent projection 1106 from the detent seat 1110. Thereafter, continued sliding movement of the retainer bar handle 1102 for instance by grasping of the handle bar 1104 along with pulling moves the sash retainer bar 202 slidably relative to the sash 104 and thereby decouples the sash retainer bar 202 relative to the sash 104. After the sash retainer bar 202 is slid from between the sash 104 and the frame 106, for instance into the open area of the fenestration assembly 100, the sash 104 is free to tilt out of the frame 106 thereby facilitating decoupling of the sash 104 from the frame 106.

in another example, the fenestration assembly 100 shown in FIGS. 11A and 11B includes the retainer bar fastening assembly 1100 using a detent in a similar manner to that shown in FIGS. 11A and 11B. For instance the detent is a spring biased system wherein a detent projection is provided on a surface of the sash member 104 and the detent projection is biased outwardly away from the surface of the sash 104 for reception within a corresponding recess of the sash retainer bar 202. The engagement of the biased detent projection in the recess of the sash retainer bar 202 fixes the sash retainer bar 202 in the fastening configuration to substantially prevent sliding movement of the sash retainer bar 202 relative to the sash 104. When decoupling of the sash retainer bar 202 from the sash 104 is desired, an operator grasps the retainer bar handle 1102 and pulls on the retainer bar handle until the pulling force exceeds the seating force of the biased detent projection within the recess of the sash retainer bar 202. Exceeding the retaining force of the detent within the recess of the sash retainer bar 202 deflects the detent downwardly against the force supplied by the biasing element to free the sash retainer bar 202 to slide freely relative to the sash 104 and thereby facilitate decoupling of the sash 104 as previously described herein.

Figure 12A:
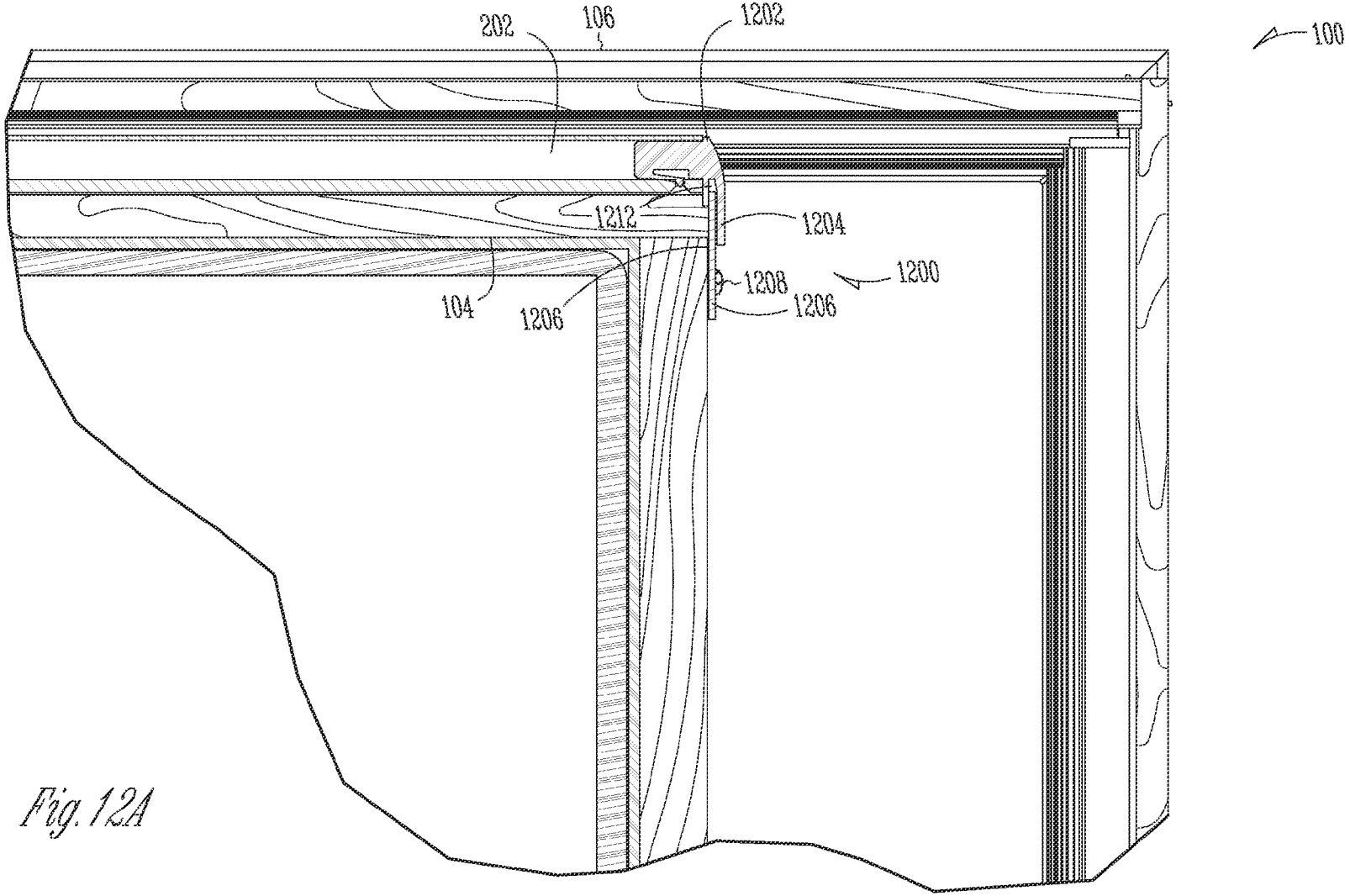
FIG. 12A shows a detailed cross-sectional view of the sash retainer bar and still another example of a retainer bar fastener assembly in a fenestration assembly.
Figure 12B:
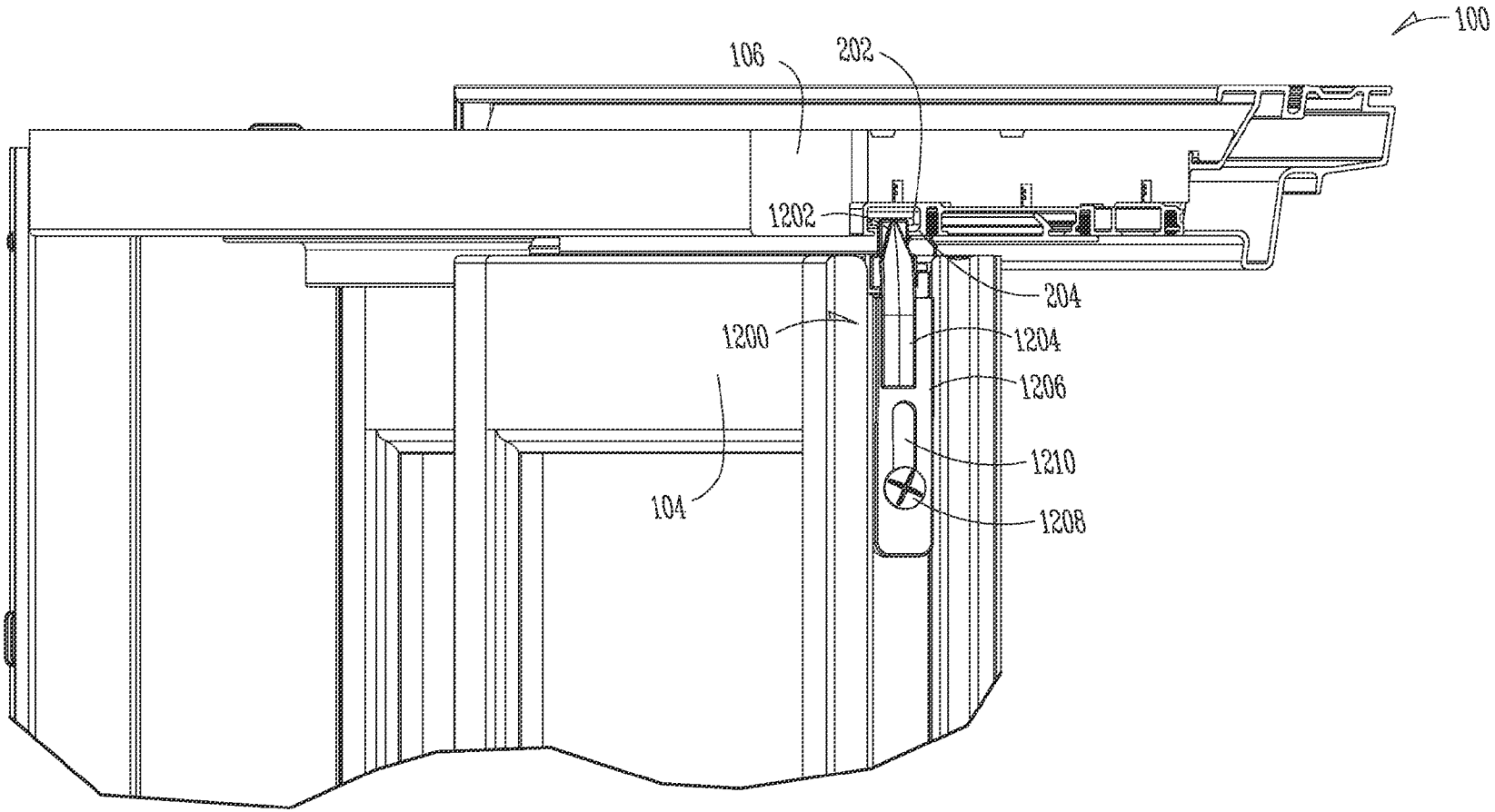
FIG. 12B shows a detailed cross-sectional view of a fenestration unit exposing the sash retainer bar and the retainer bar fastener assembly shown in FIG. 12A taken along a plane perpendicular to the plane of the fenestration unit.

FIGS. 12A and 12B show yet another example of a fenestration assembly) including a retainer bar assembly having the sash retainer bar 202 and a retainer bar fastening assembly 1200. As previously described with the other fenestration assemblies, the fenestration assembly 100 includes at least some features similar to the previously described examples. For instance, the fenestration assembly 100 includes one or more sashes 104 slidably received within the frame 106. In the example shown in FIG. 12A, the retainer bar fastening assembly 1200 selectively couples the sash retainer bar 202 with the sash member 104. As shown in FIG. 12A, the retainer bar handle 1202 coupled with the sash retainer bar 202 includes a slide seat 1212 configured to receive a retainer slide 1206 coupled with the sash 104. In one example, the retainer slide 1206 is coupled along the sash member 104 with a slide rail 1208 (e.g., a screw, tie, or other feature). The slide rail 1208 is configured to substantially prevent lateral movement of the retainer slide 1206 away from the sash 104 while selectively allowing slidable movement of the retainer slide 1206 for instance into a fastening configuration shown in FIG. 12A with the slide seat 1212 (e.g., the surfaces of the retainer bar handle 1202 or the retainer bar 202 at least partially surround the recess containing a part of the retainer slide 1206 therein).

Referring now to FIG. 12B, the retainer slide 1206 is shown with a slide guide 1210 formed within the slide. As shown the slide rail 1208 is positioned within the slide guide 1210 to facilitate sliding movement of the retainer slide 1206 for instance after loosening of the slide rail such as by rotation of the slide rail (e.g., a screw) relative to the sash 104. Optionally loosening of the slide rail 1208 facilitates the sliding movement of the retainer slide 1206 along the sash 104. Referring again to FIG. 12A, sliding movement of the retainer slide 1206 for instance in a downward direction relative to the fastening configuration shown in FIG. 12A moves the retainer slide 1206 into a releasing configuration. In the releasing configuration, the retainer slide 1206 is decoupled from the retainer bar handle 1202. Movement of the retainer slide 1206 into the releasing configuration allows for the operator to grasp the handlebar 1204 of the retainer bar handle 1202 and slide the sash retainer bar 1202 and the retainer bar handle 1202 from between the sash 104 and the frame 106. As previously described in other examples, sliding movement of the sash retainer bar 202 out of engagement therebetween facilitates the tilting of the sash 104 and decoupling of the sash 104 from the frame 106. In another example, the retainer slide 1206 is configured for sliding movement and engagement with a portion of the sash retainer bar 202. For instance, the sash retainer bar 202 includes the retainer bar handle 1202 in an integral configuration or alternatively does not include the retainer bar handle 1202. The retainer slide 1206 is instead configured to engage with the corresponding portion of the sash retainer bar 202, for instance a recess therein, to transition selectively fix and release the sash retainer bar 202 from the sash 104.

Figure 13A:
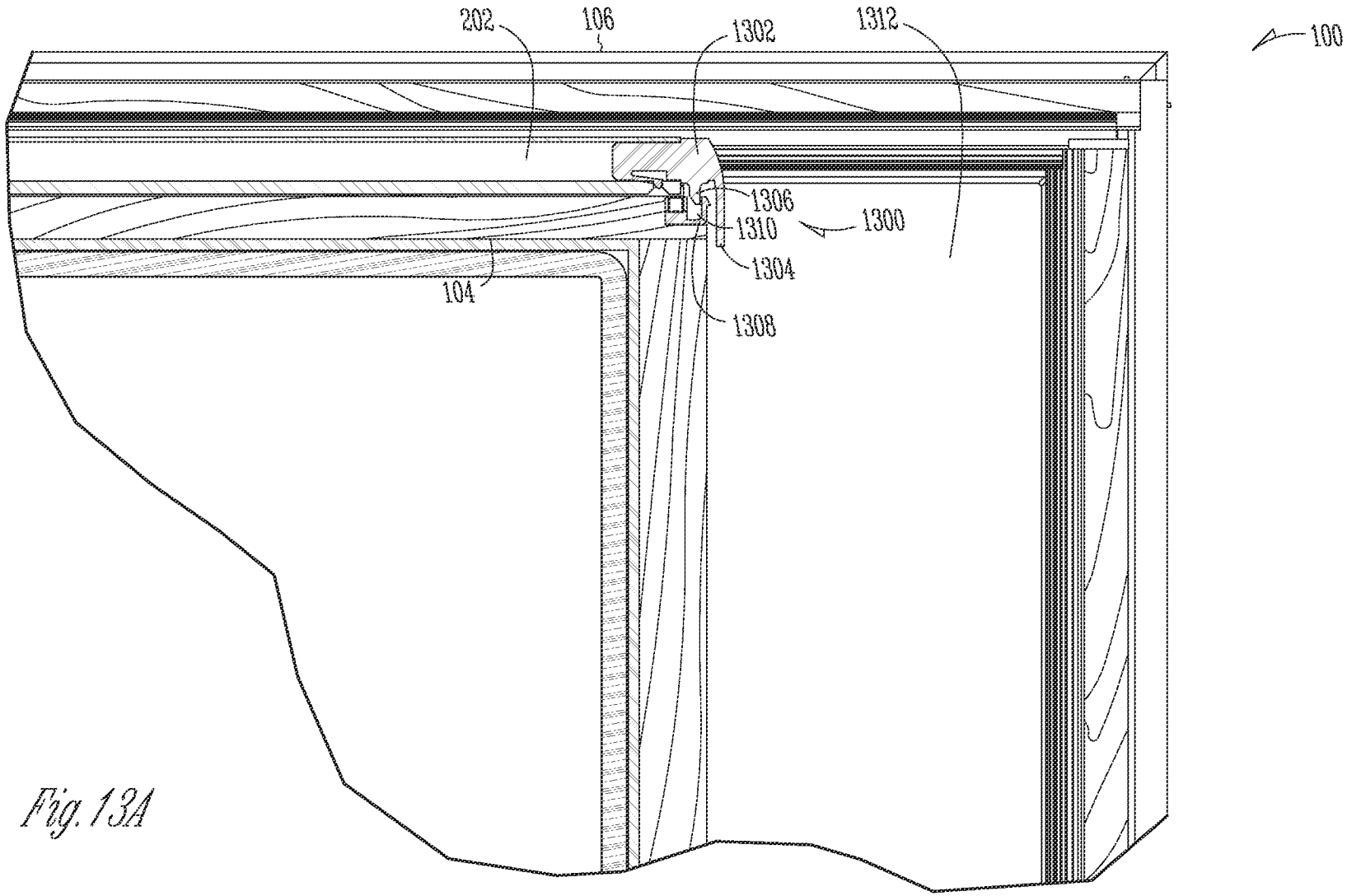
FIG. 13A shows a detailed cross-sectional view of the sash retainer bar and an additional example of a retainer bar fastener assembly in a fenestration assembly.
Figure 13B:
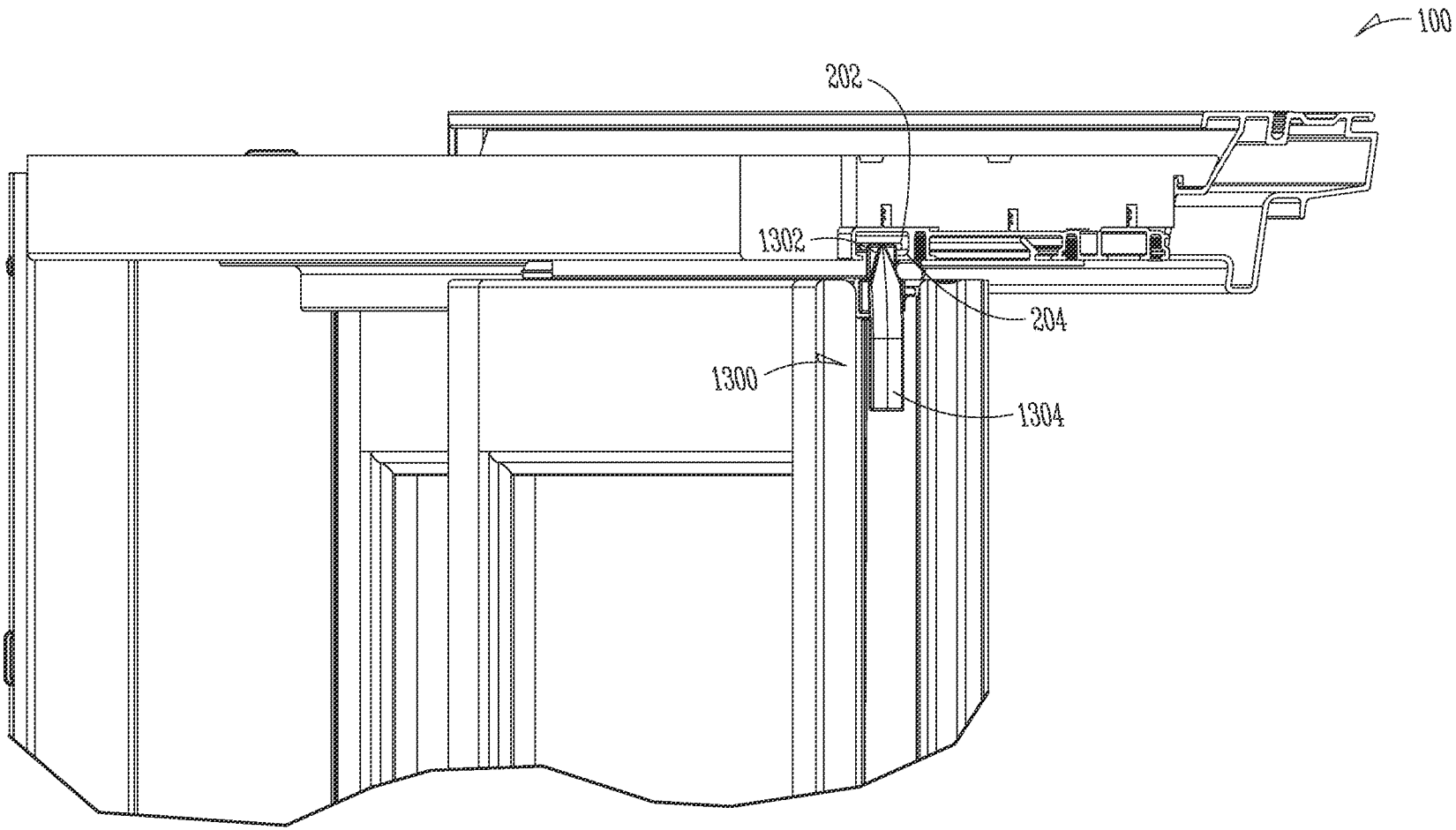
FIG. 13B shows a detailed cross-sectional view of a fenestration unit exposing the sash retainer bar and the retainer bar fastener assembly shown in FIG. 13A taken along, a plane perpendicular to the plane of the fenestration unit.

FIGS. 13A and 13B show still another example of a retainer bar assembly including the sash retainer bar 202 and a retainer bar fastening assembly 1300 incorporated within a fenestration assembly 100. As with the previous examples, the fenestration assembly 100 includes some features in common. For instance, the fenestration assembly 100 includes one or more sashes 104 slidably received within the frame 106. Similarly a sash retainer bar 202 is coupled between the sash 104 and the frame 106. In the fastening configuration shown in FIG. 13A the sash retainer bar 202 is fixably held relative to the sash member 104 while being slidably engaged with the frame 106. A retainer bar handle 1302 is coupled with an end of the sash retainer bar 202 and provides one or more gripping surfaces for easy grasping by a user during operation of the retainer bar fastening assembly 1300.

The retainer bar fastening assembly 1300 shown in FIGS. 13A and 13B includes a pawl 1306, for instance projected behind a handle bar 1304 of the retainer bar handle 1302. The pawl 1306 is sized and shaped for reception proximate a retaining lug 1308 coupled with the sash 104. As shown in FIG. 13A, the retaining lug 1308 forms a recess 1310 for reception or seating of the pawl 1306 therein. When movement of the retainer bar fastening assembly 1300 to the releasing configuration is desired, an operator grasps the handlebar 1304 of the retainer bar handle 1302 and provides upward pressure to the retainer bar handle 1302 to move the pawl 1306 out of interfering engagement with retaining lug 1308. In another example, the retaining lug 1308 is capable of deflection, and pulling motion on the retainer bar handle 1302 correspondingly moves the pawl 1306 into engagement with retaining lug 1308 to deflect the retaining lug and allowing the pawl 1306 to pass over the retaining lug 1308 thereby moving the sash retainer bar 202 into a releasing configuration (e.g., the sash retainer bar 202 is slid from between the sash 104 and the frame 106).

Referring now to FIG. 13B, the fenestration assembly 100 is shown in a partially open configuration with the retainer bar fastening assembly 1300 in a fastening configuration (e.g., where the sash retainer bar 202 is statically held relative to the sash 104 while being slidably engaged with the frame or frame liner 204). As shown, the retainer bar handle 1302 presents the handlebar 1304 extending into a frame opening 1312 while the sash 104 is in at least a partially open configuration such as that shown in FIG. 13B. While in the partially open configuration, the retainer bar handle 1302 is exposed and accessible for operator use. For instance, the operator grasps the bar handle 1304 within the perimeter of the frame 106 and pulls or lifts the retainer bar handle 1302 upwardly relative to the sash 104. As previously described, either or both of pulling and upward movement of the retainer bar handle 1302 unseats the pawl 1306 relative to the recess 1310 thereby allowing for sliding movement of the sash retainer bar 202 (as well as the retainer bar handle 1302) from the sash 104.

In many of the retainer bar fastening assembly examples shown herein, the retainer bar fastening assemblies 200, 1000, 1100, 1200, 1300 are shown as including retainer bar handles 400, 1002, 1102, 1202, 1302. While the retainer bar handles may be incorporated into the retainer bar fastening assemblies, at least some of the fastener assemblies described herein are equally applicable for use where the retainer bar fastener is received or engaged with the corresponding portion of the sash retainer bar 202 without actual engagement or interplay with the retainer bar handles 400, 1002, 1102, 1202, 1302. Stated another way, the retainer bar fastening assemblies 200, 1000, 1100, 1200, 1300 in at least some examples includes a retainer bar fastener without the retainer bar handle. Instead, the retainer bar fastener is configured to engage or couple with one or both of the retainer bar handle 400, 1002, 1102, 1202, 1302 or the sash retainer bar 202. Optionally, the retainer bar fastening assemblies described herein include only the retainer bar fasteners described herein (bolts, pins, detents and the like) without one or both of the sash retainer bar 202 or the retainer bar handles 400, 1002, 1102, 1202, 1302.

Figure 14:
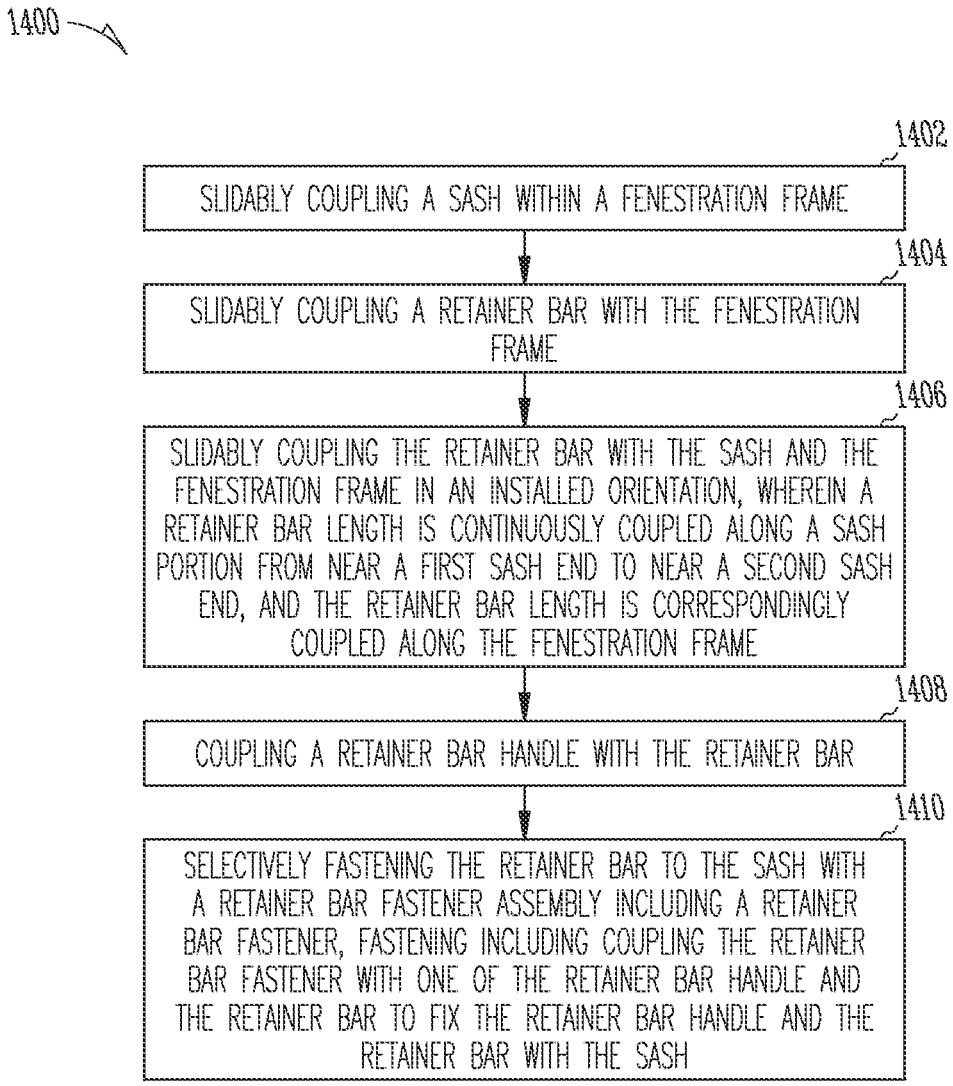
FIG. 14 is a block diagram showing one example of a method for making a fenestration assembly.

FIG. 14 shows one example of a method 1400 for making a fenestration assembly such as the fenestration assemblies 100 previously described herein. While describing the method 1400 reference is made to features and elements previously described herein. Where applicable reference numbers are provided. Any reference numbers provided in the description of FIG. 14 are intended to be exemplary and not inclusive. For instance, a feature or element described with the method 1400 includes all similar elements and features described herein as well as their equivalents. At 1402, a sash 104 is slidably coupled within a fenestration frame 106 (see FIGS. 1 and 2). For instance, the sash 104 is slidably coupled with fenestration frame with a series of tracks or rollers along at least one surface, for instance, a lower most surface of the sash. At 1404, a retainer bar 202 is slidably coupled with fenestration frame 106. For instance, the sash retainer bar 202 is coupled with the frame 106 as shown in FIG. 3B. Stated another way, the sash retainer bar 202 is spaced from the sash 104 while the sash 104 is in a substantially open configuration.

At 1406, the sash retainer bar 202 is slidably coupled with the sash 104 and the fenestration frame 106 in an installed orientation such as the orientation shown in FIGS. 2 and 3A. The length of the sash retainer bar 202 is continuously coupled along a sash portion from near a first sash end 110 to near a second sash end 112. The retainer bar length 202 is correspondingly coupled along the fenestration frame 106. Stated another way, the sash retainer bar 202 provides a continuous interface between the sash and the frame from near the first sash end 110 to near the second sash end 112. Point loading, for instance, caused by tilt latches and the like is thereby substantially avoided. Instead, wind and mechanical loads applied to the sash 104 (e.g., by way of children, burglars, wind, debris and the like) are transmitted and distributed across the entire sash retainer bar 202 from the sash and then correspondingly transmitted to the frame 106 without any point stresses therebetween.

At 1408, a retainer bar handle 400 is coupled with the retainer bar 202. At 1410, the retainer bar 202 is selectively fastened to the sash 104 with a retainer bar fastener assembly 200. The retainer bar fastener assembly 200 includes a retainer bar fastener, for instance a movable bolt 408. Fastening the retainer bar 202 to the sash includes coupling the retainer bar fastener with one of the retainer bar handle 400 (coupled with the sash retainer bar 202) or the retainer bar 202. The sash retainer bar 202 is thereafter fixed to the sash 104 and substantially prevented from moving relative to the sash. For instance, slidable movement between the sash retainer bar 202 and the sash 104 is substantially prevented at least until the retainer bar fastener assembly is operated to decouple the sash retainer bar 202 from the sash 104 thereby allowing slidable movement therebetween.

Several options for the method 1400 are provided below. In one example, slidably coupling the retainer bar 202 with the sash 104 and the fenestration frame 106 includes slidably coupling the retainer bar 202 along the fenestration frame 106. The retainer bar 202 is at a spaced location from the sash 104 when installed as shown in FIG. 3B. The method 1400 further includes sliding the retainer bar 202 into the installed orientation between the fenestration flume and the sash (see FIGS. 2, 3A) from the spaced location. In another example, slidably coupling a sash retainer bar 202 with the sash 104 and the fenestration frame 106 includes retaining the sash 104 in a substantially parallel orientation with the fenestration frame. Stated another way, the sash 104 is held within the perimeter of the fenestration frame 106 at least in part through the interface with the sash retainer bar 202 and thereafter configured for sliding movement along the frame according to the geometry, in the various tracks, runners and the like formed within the frame.

In yet another example, coupling the retainer bar handle 400 with retainer bar 202 includes inserting a portion of the retainer bar handle into a bar channel 402. Optionally, coupling the retainer bar fastener with one of the retainer bar handle 400 and the retainer bar 202 includes moving a movable bolt 408 into a fastening configuration where the movable bolt 408 overlies a portion of the retainer bar 202 (e.g., an end portion of the retainer bar). In yet another example, moving the movable bolt 408 includes biasing the movable bolt 408 into the fastening configuration with a biasing element 902 (e.g., such as a spring).

CONCLUSION

The sash retainer bar assembly described herein provides a feature that easily maintains a sash or door panel upright within a frame until decoupling is desired. The user operates the assembly to release the sash retaining bar at a single location along the sash and the frame. Where the sash retainer bar includes a retainer bar handle, the operator is able to eject a portion of the retainer bar to facilitate grasping of the same and full disengagement of the bar from the sash by sliding within the liner (frame) channel. Labor intensive lifting of the entire sash (or door panel) to compress a lengthy compression header extending the length of a sash or door panel is thereby avoided. Similarly, the operation of a plurality of tilt latches is avoided and the releasing of the sash from the frame is performed at the single retainer bar fastener assembly.

Further, because the sash retainer bar extends along a portion of the sash, such as the full length, the sash retainer bar eliminates point loading otherwise possible with tilt latches and the like. Instead, loads including wind loads, physical pressure (animals, children and burglars) are transmitted throughout the length of the sash retainer bar and correspondingly transmitted to the frame. The sash or door panel is thereby reliably retained within the frame despite the application of these forces. Stated another way, the sash retainer bar provides a continuous interface between the sash and the frame, for instance between locations proximate to the first and second sash ends.

The sash retainer bar assembly is covered and concealed within the framework of the sash and the fenestration unit. Where the sash is in a closed orientation the sash retainer bar assembly is fully housed within the recesses of the fenestration frame. In one example, the retainer bar is only visible through a shadow line between the frame header and the sash or door panel.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process example may be executed in any order and are not limited to the explicit order presented in the specific examples. Additionally, the components and/or elements recited in any apparatus example may be assembled or otherwise operationally configured in a variety of permutations to produce substantially the same result as the present subject matter and are accordingly not limited to the specific configuration recited in the specific examples.

Benefits, other advantages and solutions to problems have been described above with regard to particular examples; however, any benefit, advantage, solution to problems or any element that may cause any particular benefit, advantage or solution to occur or to become more pronounced are not to be construed as critical, required or essential features or components.

As used herein, the terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to examples. However, changes and modifications may be made to the examples without departing from the scope of the present subject matter. These and other changes or modifications are intended to be included within the scope of the present subject matter, as expressed in the following claims.

It is to be understood that the above description is intended to be illustrative, and not restrictive. Many other examples will be apparent to those of skill in the art upon reading and understanding the above description. It should be noted that examples discussed in different portions of the description or referred to in different drawings can be combined to form additional examples of the present application. The scope of the subject matter should, therefore, be determined with reference to the appended claims, along with the full scope of equivalents to which such claims are entitled.

What is claimed is:

1. A retainer bar assembly for use with a door or window comprising:

a retainer bar configured for slidable coupling with a fenestration frame and slidable coupling with a sash;

a retainer bar handle coupled with the retainer bar; and a retainer bar fastener assembly including a movable bolt, the movable bolt is movably coupled with the sash, and the movable bolt is movable between a fastening configuration where the movable bolt is coupled with at least one of the retainer bar and the retainer bar handle and the retainer bar is fixed in an installed orientation relative to the sash, and a releasing configuration where the movable bolt is disconnected from one or more of the retainer bar and the retainer bar handle and the retainer bar is slidable relative to the sash to a completely disconnected position from the sash.

2. The retainer bar assembly of claim 1, wherein the retainer bar handle includes a follower surface.

3. The retainer bar assembly of claim 2, wherein the movable bolt includes a camming surface engageable with the follower surface, and engagement of the camming surface with the follower surface in the releasing configuration biases the retainer bar handle and the retainer bar away from a sash.

4. The retainer bar assembly of claim 1, wherein the retainer bar fastener assembly includes a bolt housing configured for coupling with the sash, the movable bolt is movably coupled within the bolt housing.

5. The retainer bar assembly of claim 1 comprising a biasing element coupled with the movable bolt, the biasing element is configured to bias the movable bolt toward the fastening configuration.

6. The retainer bar assembly of claim 1 comprising:
the fenestration frame; and
the sash slidably coupled within the frame.

7. The retainer bar assembly of claim 6, wherein the fenestration frame includes a frame opening, and the retainer bar handle includes a handle projection extending into the frame opening while the sash in at least a partially open configuration.

8. The retainer bar assembly of claim 6, wherein the retainer bar includes one or more glider tabs slidably coupled along one or more liner rails of a frame liner coupled with the fenestration frame.

9. The retainer bar assembly of claim 6, wherein the retaining bar includes one or more engagement pins slidably received within one or more engagement recesses of the sash.

10. The retainer bar assembly of claim 1, wherein the retainer bar includes a retainer bar length configured to continuously couple along a sash portion from near a first sash end to near a second sash end, and the retainer bar length is configured to correspondingly couple along the fenestration frame and provide a continuous interface between the sash and the fenestration frame therebetween.

11. The retainer bar assembly of claim 1, wherein the retainer bar handle is integral to the retainer bar.

12. A fenestration assembly comprising:
a fenestration frame;
a sash slidably coupled within the fenestration frame;
a retainer bar slidably coupled with the fenestration frame and slidably coupled with the sash, a retainer bar length of the retainer bar is continuously coupled along a sash portion from a first location near a first sash end to a second location near a second sash end in an installed orientation, the retainer bar is a continuous interface between the sash and the fenestration frame from the first location to the second location;
a retainer bar handle coupled with the retainer bar; and
a retainer bar fastener assembly including a retainer bar fastener selectively coupled with the sash and at least one of the retainer bar and the retainer bar handle, wherein the retainer bar fastener is movable between a fastening configuration configured to fix the retainer bar with the sash in the installed orientation, and a releasing configuration configured to release the retainer bar from the sash for relative sliding movement therebetween.

13. The fenestration assembly of claim 12, wherein the retainer bar fastening assembly includes:
a bolt housing coupled with the sash, and
the retainer bar fastener includes a movable bolt, the movable bolt is slidably coupled within the bolt housing, and the movable bolt is slidable between the fastening configuration where the movable bolt is coupled with at least one of the retainer bar and the retainer bar handle, and the releasing configuration where the movable bolt is decoupled from one or more of the retainer bar and the retainer bar handle and the retainer bar is slidable relative to the sash.

14. The fenestration assembly of claim 13, wherein the retainer bar handle includes a follower surface and the movable bolt includes a camming surface engageable with the follower surface, and engagement of the camming and follower surfaces biases the retainer bar handle and the retainer bar away from the sash.

15. The fenestration assembly of claim 12, wherein the retainer bar fastener includes a pin selectively coupled with the retainer bar handle, the pin extends through a handle projection of the handle bar and the sash in the fastening configuration, and the pin is decoupled from at least the sash in the releasing configuration and the retainer bar is slidable relative to the sash.

16. The fenestration assembly of claim 15, wherein the pin includes a screw.

17. The fenestration assembly of claim 12, wherein the retainer bar fastener assembly includes:
the retainer bar fastener including a detent projection coupled with one of the sash and the retainer bar handle, and
a detent seat coupled with the other of the retainer bar handle and the sash, the detent seat is sized and shaped to receive the detent projection, and one or more of the detent projection or the detent seat are sized and shaped to deform and grasp the other of the detent seat or the detent projection.

18. The fenestration assembly of claim 17, wherein the detent seat includes deformable socket arms, and the detent projection includes a flared end sized shaped for reception between the deformable socket arms.

19. The fenestration assembly of claim 17, wherein the detent projection includes a biased detent projection along a first side surface of the sash or the retainer facing a second side surface of the other of the retaining bar and the sash, and the detent seat is positioned along the second side surface.

20. The fenestration assembly of claim 12, wherein the retainer bar fastener assembly includes:
the retainer bar fastener including a retainer slide slidably coupled along the sash, and
a slide seat in the retainer bar handle, the slide seat is sized and shaped to receive at least a portion of the retainer slide in the fastening configuration.

21. The fenestration assembly of claim 12, wherein the retainer bar fastener assembly includes:
the retainer bar fastener including a pawl on one of the sash or the retainer bar handle, and
a retaining lug on the other of the retainer bar handle or the sash, wherein the pawl retains the retaining lug in the fastening configuration, and the retaining lug is positioned beyond the pawl in the releasing configuration.

22. The fenestration assembly of claim 12, wherein the fenestration frame includes a frame opening, and the retainer bar handle includes a handle projection extending into the frame opening while the sash is in at least a partially open configuration.

23. The fenestration assembly of claim 12, wherein the releasing configuration includes the retainer bar fastener disconnected from one or more of the retainer bar and the retainer bar handle and the retainer bar is slidable relative to the sash to a completely disconnected position from the sash.

* * * * *